US007350472B2

(12) United States Patent
Seki et al.

(10) Patent No.: US 7,350,472 B2
(45) Date of Patent: Apr. 1, 2008

(54) WORK POSITIONING DEVICE

(75) Inventors: Shinichiro Seki, Tokyo (JP); Satoko Yamada, Tokyo (JP); Masashi Ninomiya, Tokyo (JP); Koshiro Omiya, Tokyo (JP)

(73) Assignee: Janome Sewing Machine Co., Ltd, Tokyo (JP)

( * ) Notice: Subject to any disclaimer, the term of this patent is extended or adjusted under 35 U.S.C. 154(b) by 0 days.

(21) Appl. No.: 11/507,608

(22) Filed: Aug. 22, 2006

(65) Prior Publication Data

US 2007/0050078 A1 Mar. 1, 2007

(30) Foreign Application Priority Data

Aug. 31, 2005 (JP) ..... 2005-252059

(51) Int. Cl.
*D05B 27/00* (2006.01)

(52) U.S. Cl. ..... 112/306; 112/102.5

(58) Field of Classification Search ..... 700/130, 700/138; 112/78, 80.32, 102, 102.5, 103, 112/104, 115, 136, 148, 178, 257, 258, 303, 112/306, 311; 38/102.2, 102.4, 102.91; 33/1 AA, 33/11

See application file for complete search history.

(56) References Cited

U.S. PATENT DOCUMENTS

| | | | | |
|---|---|---|---|---|
| 4,767,111 | A * | 8/1988 | Guenther | 269/303 |
| 4,774,778 | A * | 10/1988 | Williams | 38/102.2 |
| 5,144,899 | A * | 9/1992 | Allen | 112/103 |
| 5,855,176 | A * | 1/1999 | Takenoya et al. | 112/102.5 |
| 6,775,934 | B1 * | 8/2004 | Gallik et al. | 38/102.2 |
| 6,932,006 | B1 * | 8/2005 | Morkovsky | 112/103 |

FOREIGN PATENT DOCUMENTS

| | | |
|---|---|---|
| JP | 3163299 | 2/2001 |

* cited by examiner

*Primary Examiner*—Gary L. Welch
*Assistant Examiner*—Nathan E Durham
(74) *Attorney, Agent, or Firm*—McGinn IP Law Group, PLLC

(57) ABSTRACT

A work positioning device for a computer sewing machine includes an auxiliary table and a positioning arm having one end removably and turnably connected to the auxiliary table. The positioning arm has the opposite end provided with a positioning part and may be turned between an upper position where the positioning part is spaced from the upper surface of the auxiliary table and a lower position where the positioning part is in contact with the upper surface of the table, the positioning part having a reference mark provided for showing an initialized position for starting the pattern stitching operation when the embroidery frame is connected to the carriage.

16 Claims, 23 Drawing Sheets

WORK POSITIONING DEVICE

BACKGROUND OF THE INVENTION

1. Field of the Invention

The present invention relates to a work positioning device and more particularly relates to a device for positioning a work to be embroidered by means of a computer sewing machine.

2. Description of the Related Art

So far, the embroidery stitching operation has been carried out by use of a computer sewing machine, wherein pattern data are selectively read out of a memory to control the operation of a drive mechanism having an output end to which is connected an embroidery frame holding a work to be embroidered, so that a selected pattern may be automatically stitched to the work. It is, however, difficult to position the work relative to the embroidery frame so as to stitch the selected pattern accurately at an optional position of the work. Particularly it is difficult for a beginner or neophyte user of a home computer sewing machine to set the work accurately to the embroidery frame so that the selected pattern will not incline relative to an optional position or will not displaced from the optional position of the work.

For the purpose of solving the problems of prior art, particularly for stitching a selected pattern accurately at an optional position of a work held by an embroidery frame and connected to a computer sewing machine so as to be embroidered, a work positioning device is disclosed in Japanese patent No. 3163299 given to the same applicant of this patent application, wherein a table has a portion provided therewith for supporting an embroidery frame for holding a work to be embroidered, the frame supporting portion being substantially same with a frame attaching portion of a carriage of sewing machine, and wherein a positioning arm has one end turnably connected to a holding means provided on the table, and has the opposite end provided with a frame having a transparent plate fitted thereto, the transparent plate having a reference mark of crossed lines provided thereat for showing a initialized position for starting the pattern stitching operation when the embroidery frame is connected to the carriage. Thus the positioning arm may be turned between an upper position where the frame is spaced from the upper surface of the table and a lower position where the frame is in contact with the upper surface of the table. The work has a mark of crossed lines provided at an optional position thereof. The mark of crossed lines is put upon the reference mark of crossed lines of the transparent plate so that the mark of crossed lines come in accord with the reference mark, thereby to confirm the position of the work to be held by the embroidery frame, the position of the work corresponding to the initialized position of the carriage, while the embroidery frame is connected to the frame supporting portion of the table.

SUMMARY OF THE INVENTION

The subject matter of the Japanese patent attains its own object, but fails to solve other problems. According to the subject matter, the position of the carriage is fixed and unchanged irrespectively of the size of the embroidery frame. Therefore a plurality of embroidery frames of different sizes can not be used. Further the device has all the needed elements secured thereto and not removably arranged and designed only to be used for positioning the work. Therefore, the device requires a large space for storing after the device is used. It is, therefore, an object of the invention to provide a work positioning device for a computer sewing machine which may be used in accordance with a plurality of positions of carriage and may be easily stored in a small space after the device is used.

The invention has been provided to eliminate the defects and disadvantages of prior art. It is, therefore, an object of the invention as described in claim 1, wherein the invention relates to a work positioning device for a computer sewing machine having a memory for storing therein the pattern data of a plurality of different embroidery patterns which are selectively read out of the memory to drive a carriage of the sewing machine carrying an embroidery frame holding a work to be embroidered, thereby to control the operation of the embroidery frame relative to a machine needle, the embroidery frame being set to an initialized position prior to starting an embroidery stitching operation, the work positioning device comprising;

an auxiliary table of the computer sewing machine having a portion provided therewith for supporting the embroidery frame, the frame supporting portion being substantially same with a frame attaching portion of the carriage, a positioning arm having one end removably and turnably connected to a holding means provided on the auxiliary table, the positioning arm having a positioning part provided at the opposite end for positioning the work so that a selected pattern may be stitched at an optional position of the work, the positioning arm being turned between an upper position where the positioning part is spaced from the upper surface of the auxiliary table and a lower position where the positioning part is in contact with the upper surface of the auxiliary table, the positioning part having a reference mark of crossed lines provided thereat, the reference mark showing a initialized position for starting the pattern stitching operation when said embroidery frame is connected to the carriage, the work having a mark of crossed lines provided at an optional position thereof, the mark of crossed lines being put upon the reference mark of crossed lines of the positioning part so that the mark of crossed lines come in accord with the reference mark, thereby to confirm the position of the work to be held by the embroidery frame, the position of the work corresponding to the initialized position of the carriage, while the embroidery frame is connected to the frame supporting portion of the auxiliary table.

It is another object of the invention as described in claim 2, wherein the invention relates to a work positioning device for a computer sewing machine having a memory for storing therein the pattern data of a plurality of different embroidery patterns which are selectively read out of the memory to drive a carriage of the sewing machine carrying an embroidery frame holding a work to be embroidered, thereby to control the operation of the embroidery frame relative to a machine needle, the embroidery frame being set to an initialized position prior to starting an embroidery stitching operation, the work positioning device comprising;

a table having a portion provided therewith for supporting the embroidery frame, the frame supporting portion being substantially same with a frame attaching portion of the carriage, a positioning arm having one end removably and turnably connected to a holding means provided on said table, the positioning arm having a positioning part provided at the opposite end for positioning the work so that a selected pattern may be stitched at an optional position of the work, the positioning arm being turned between an upper position where the positioning part is spaced from the upper surface of the table and a lower position where the positioning part is in contact with the upper surface of the table, the positioning part having a reference mark of crossed lines provided thereat, the reference mark showing a initialized position for starting the pattern stitching operation when the embroidery frame is connected to the carriage, the work having a mark of crossed lines provided at an optional position thereof, the mark of crossed lines being put upon said reference mark of crossed lines of said positioning part so that the mark of crossed lines may come in accord with the reference mark, thereby to confirm the position of the work to be held by the embroidery frame, the position of the work corresponding to the initialized position of the carriage, while the embroidery frame is connected to the frame supporting portion of said table.

It is another object of the invention as described in claim 3, wherein with the structure as defined in claim 1 or 2, the positioning part includes a transparent plate having the reference mark of crossed lines provided thereat showing the initialized position for starting the pattern stitching operation when said embroidery frame is connected to said carriage of the sewing machine.

It is another object of the invention as described in claim 4, wherein the structure as defined in claim 1 or 2, the frame supporting portion may be provided in a plurality of numbers in accordance with the number of the frame attaching portion provided at the carriage. It is another object of the invention as described in claim 5, wherein the structure as defined in claim 1 or 2, the positioning arm holding means may be provided in a plurality of numbers in accordance with the number of the frame attaching portion provided at the carriage.

It is another object of the invention as described in claim 6, wherein with the structure as defined in claim 1 or 2, the positioning arm may be provided in a plurality of numbers in accordance with the number of the frame attaching portion provided at the carriage. It is still another object of the invention as described in claim 7, wherein with the structure as defined in claim 1 or 2, the positioning arm may be positionally adjustable to a plurality of frame attaching portions provided at said carriage.

According to the invention, as the positioning arm may be removed from the auxiliary table, the auxiliary table with the positioning arm removed therefrom may be attached to the sewing machine to enlarge the stitching operation area of the sewing machine. Thus the auxiliary table may be improved in utilization as well as in storage. As to the table with the positioning arm removed therefrom, the table is simply a thin plate and may be more easily stored in a small space. Further, the work positioning operation may be effectively and smoothly performed since the positioning portion of the positioning arm is provided with a transparent plate having a reference mark formed thereat for showing an initialized position for starting the embroidery stitching operation when the embroidery frame is connected to the carriage of sewing machine.

Further, according to the invention, since a plurality of frame supporting portions, a plurality of arm holding means or a plurality of positioning arms are provided in accordance with a plurality of frame attaching portions of the carriage, a selected pattern may be optionally arranged or rearranged in connection with another pattern in a larger embroidery frame.

Further according to the invention, as the holding means are provided in a plurality of numbers in accordance with a plurality of frame attaching portions of the carriage, a selected pattern may be optionally arranged or rearranged in connection with another pattern in a larger embroidery frame by use of a single positioning arm. Further according to the invention, the positioning arm may be used in connection with the embroidery frames of various sizes since a plurality of positioning arms are provided in accordance with the number of frame attaching portions provided at the carriage, or a positioning arm may be positionally adjustable to a plurality of frame attaching portions provided at said carriage.

DESCRIPTION OF THE PREFERRED EMBODIMENTS

Figure 1A:
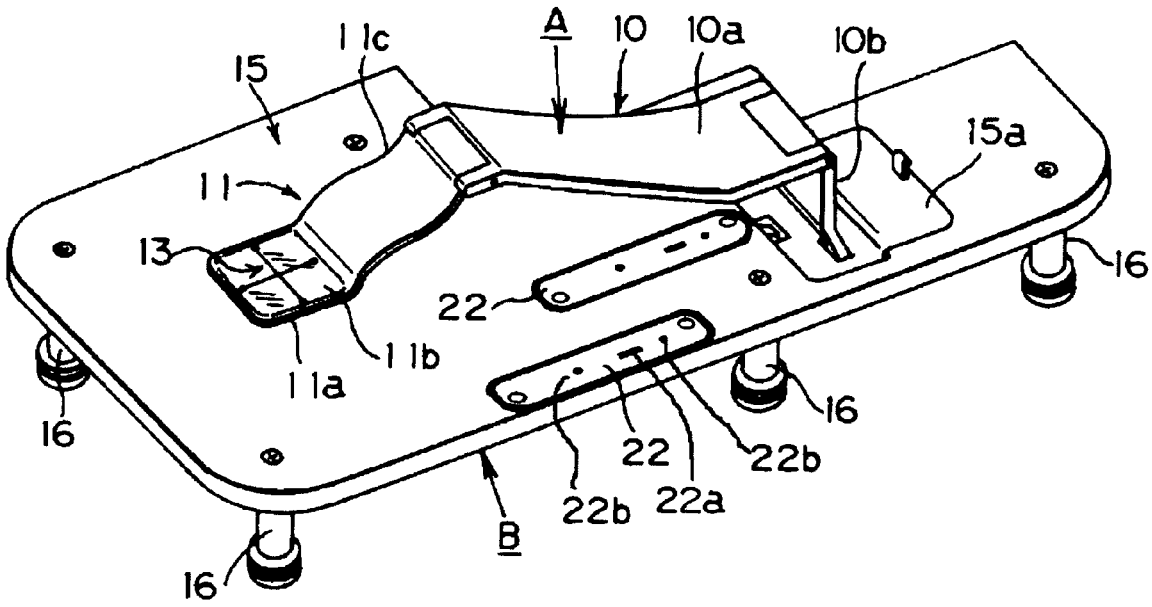
FIG. 1(*a*) is a perspective view of a work positioning device of the invention which is substantially composed of a work positioning arm and an auxiliary table. (*b*) is a plan elevational view of the work positioning device of (*a*).

The invention will be described in detail in reference to the attached drawings. As particularly shown in FIG. 3(*b*), a computer sewing machine is substantially composed of a standard 1, a machine arm 2, a machine bed 3 and a machine base 4. In the machine arm 2, there is provided a needle bar having a needle attached at the lower end thereof and being vertically reciprocated by an upper drive shaft. In the machine bed 3, there is provided a lop taker which carries a lower thread therein and is rotated in synchronism with the needle bar to catch the upper thread carried by the needle, thereby to interconnect the upper and lower threads so as to form stitches on a work or cloth to be stitched.

In the machine base 4, there is provided an X-Y drive mechanism, though not shown, which is driven by stepping motors in X and Y directions, thereby to move a carriage 6 in the X and Y directions in a compound movement, the carriage 6 being an output end of the X-Y drive mechanism and extending out of the machine bed 3 at the rear side thereof with the upper surface located at a substantially same level with the upper surface of the machine bed 3. The carriage 6 is provided to removably support an embroidery frame 7 at the neck 8 thereof. The embroidery frame 7 includes an inner frame 9 for holding a work or cloth W in a tightened condition as shown in FIG. 2(*a*), (*b*).

Figure 1B:
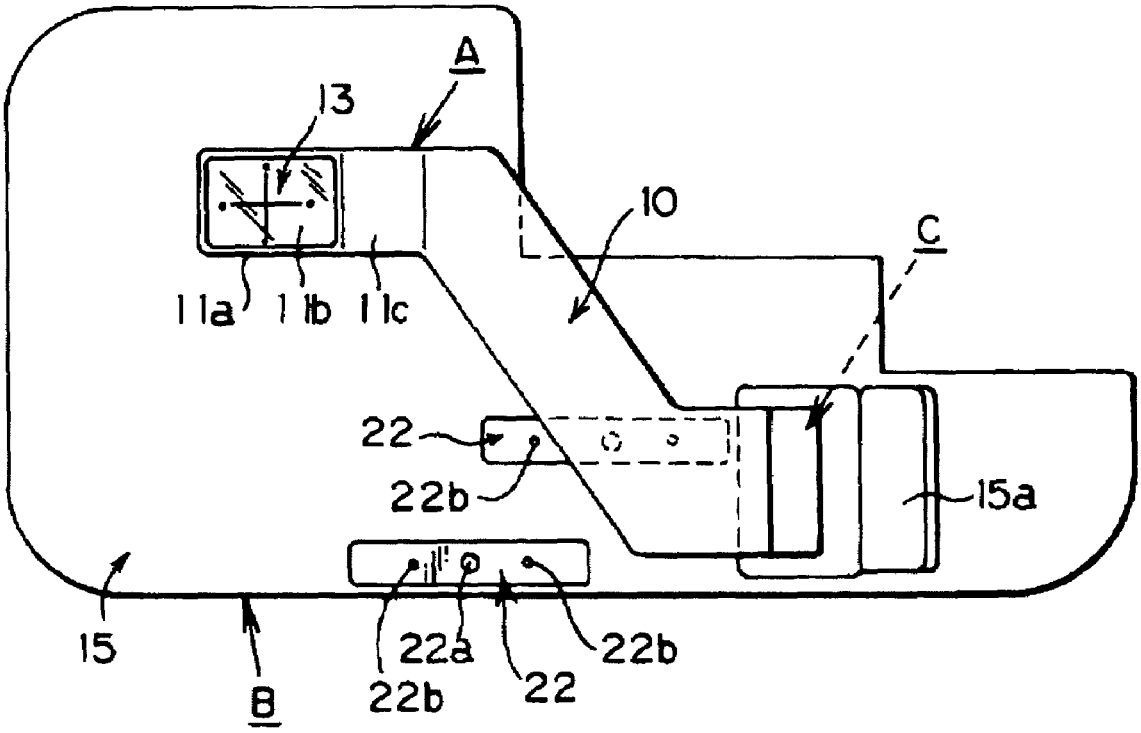
Figure 2A:
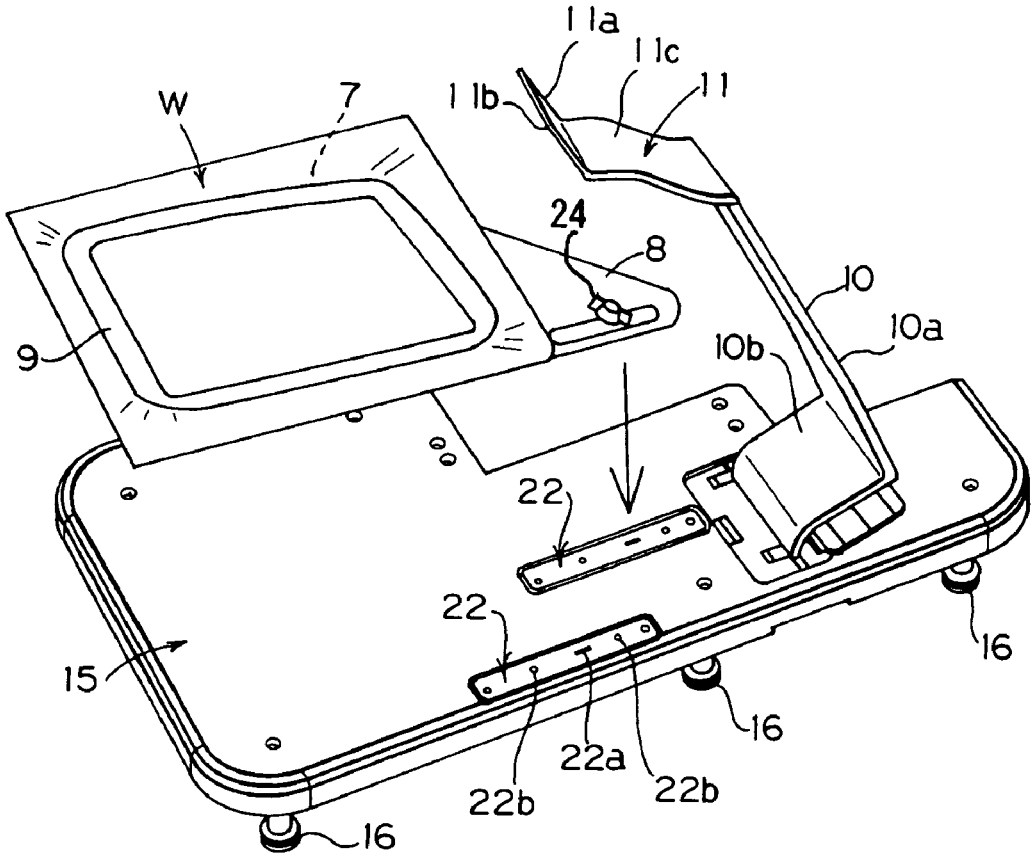
FIG. 2(*a*) is a perspective view of the work positioning device of the invention wherein a embroidering frame is going to be mounted to the auxiliary table. (*b*) is a perspective view of the work positioning device wherein the work positioning arm is operated after the embroidering frame is mounted to the auxiliary table.
Figure 2B:
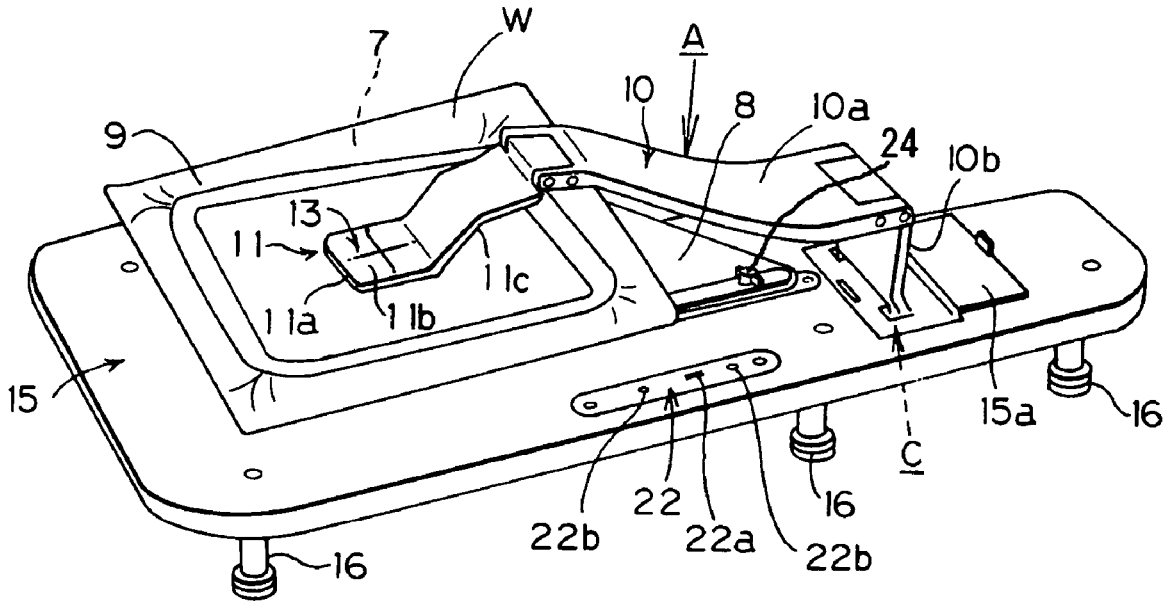
Figure 3A:
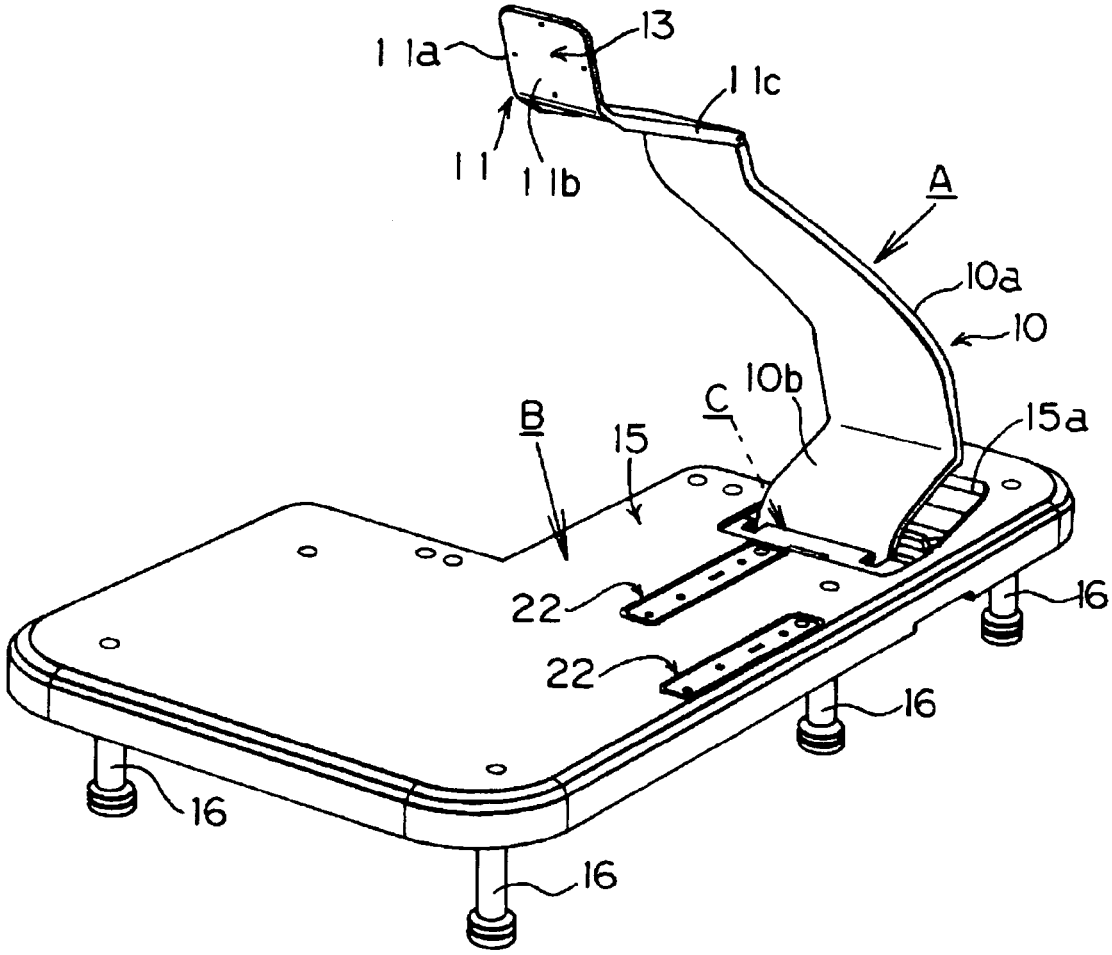
FIG. 3(*a*) is a perspective view of the work positioning device of the invention wherein the work positioning arm is swingingly moved up from the auxiliary table. (*b*) is a perspective view of a sewing machine having the auxiliary table attached thereto.
Figure 3B:
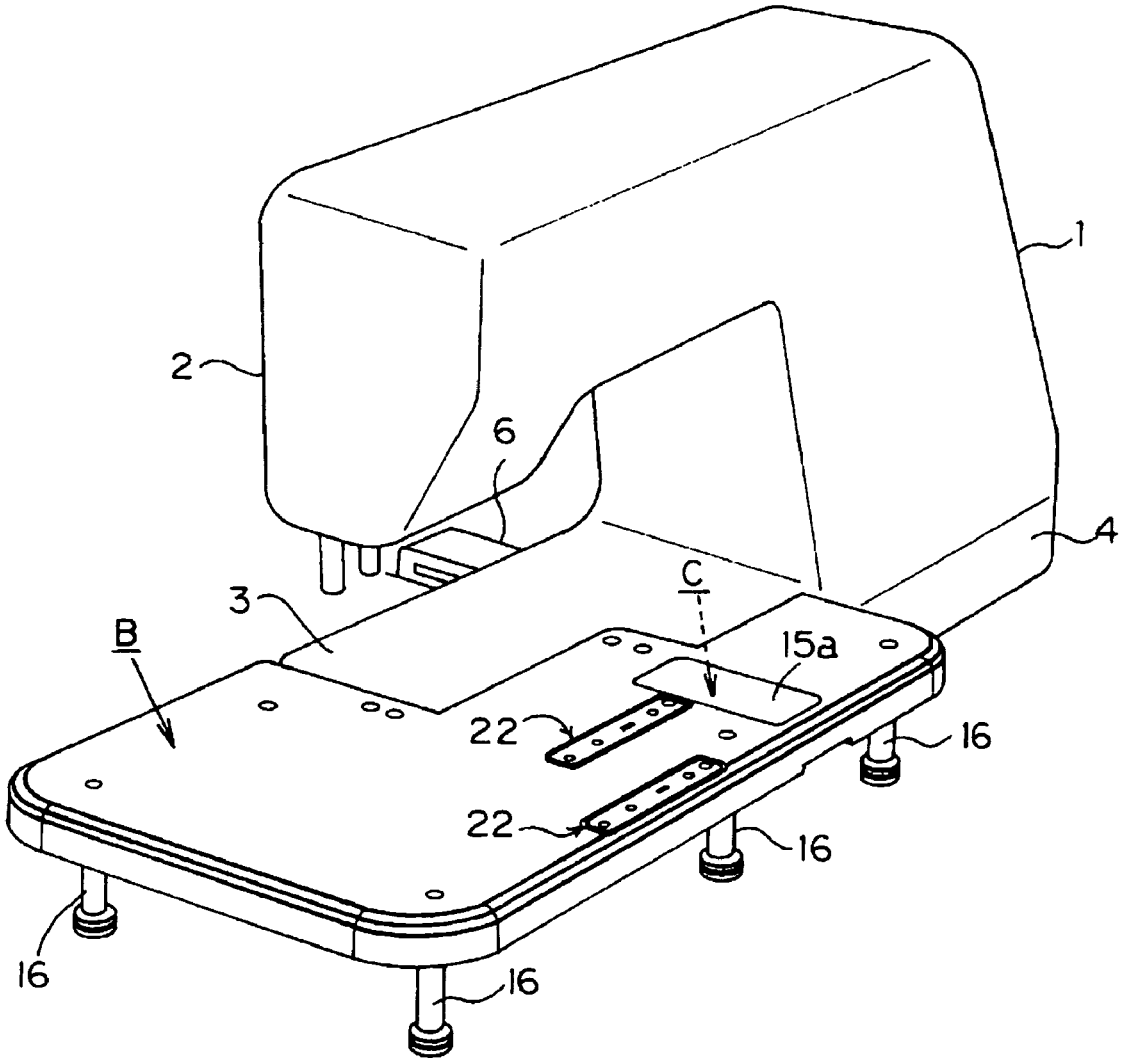
Figure 4A:
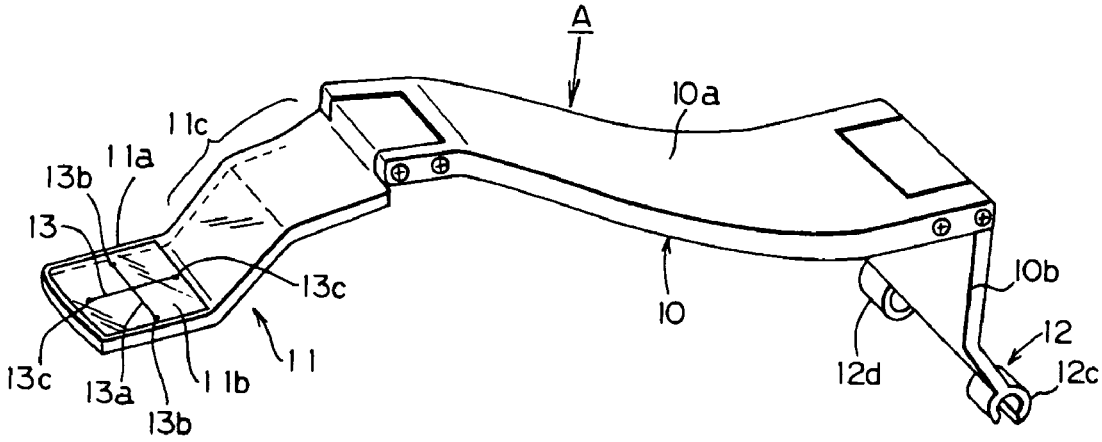
FIG. 4(*a*) is a perspective view of the work positioning arm. (*b*) is a perspective view of an essential part of the work positioning arm shown as enlarged. (*c*) is a side elevational view of an essential part of the work positioning arm taken from the arrow marks X1-X1 and shown as enlarged. (*d*) is a side elevational view of an essential part of the work positioning arm taken from the arrow marks X2-X2 and shown as enlarged.
Figure 4B:
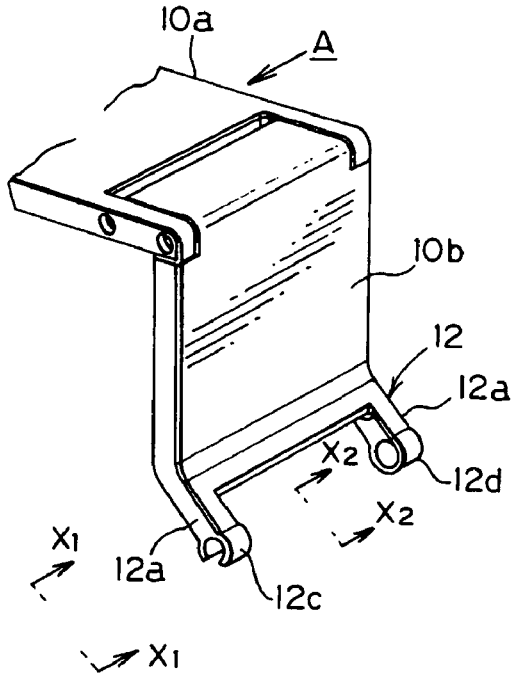
Figure 4C:
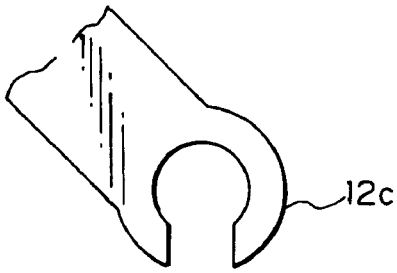
Figure 4D:
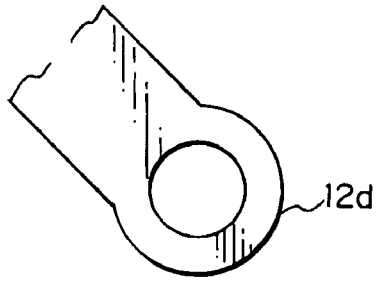

A work positioning device A that is a device A for positioning a work W to be embroidered is substantially composed of a work positioning arm 10 and an auxiliary table B which has an upper flat surface for supporting the embroidery frame 7 as shown in FIGS. 1-3. The positioning arm 10 and the auxiliary table B may be detachably connected to each other. As shown in FIG. 4(*a*), the positioning arm 10 is composed of an arm plate 10*a* a positioning part 11 at one end of the arm plate 10*a*, a bent portion 10*b* at the opposite end of the arm plate 10*a*. The bent portion 10*b* has an upper end connected to the arm plate 10*a* and has a connecting part 12 formed at the lower end thereof.

The bent portion 10*b* is substantially normal to the arm plate and has the connecting part 12 formed at the lower end thereof as shown in FIG. 4(*b*). The positioning arm 10 may be turnably connected to the auxiliary table B by means of the connecting part 12 as will be described in detail hereinlater.

The positioning part 11 is connected to one end of the arm plate 10*a*, that is, connected to the free end of the arm plate 10*a*. The positioning part 11 is composed of an extended part 11*c* having one end connected to the free end of the arm plate 10*a*, and a frame 11*a*, that is, a window 11*a* formed at the opposite free end of the extended part 11*c*. The frame 11*a* is fitted with a transparent member 11*b*.

More particularly as shown in FIG. 4(*a*), the extended part 11*c* is formed to progressively extend to lower direction and is terminated in the frame 11*a* having the transparent member 11*b* fitted therewith. Actually, the positioning part 11 may be wholly formed with a transparent synthetic resin. The transparent window 11*b* may be formed square or triangular. The transparent window 11*b* is provided with a reference mark 13 of crossed lines 13*a* as shown in FIGS. 1, 4(*a*) and 5.

In reference to FIGS. 1(*a*) and 2(*b*), the positioning arm 10 may be turned between the upper position where the frame 11*a* of the positioning part 11 is spaced from the upper flat surface of the auxiliary table B and the lower position where the frame 11*a* is pressed against a predetermined position of the upper flat surface of the auxiliary table B, the lower predetermined position corresponding to a site of the embroidery frame 7 which is connected to a predetermined position of the auxiliary table B, the predetermined position of the auxiliary table B corresponding to the carriage 6 of the sewing machine which is located at the initialized position thereof. Thus the area surrounded by the frame 11*a* is the area of embroidery stitches to b formed.

According to the invention, a plurality of pattern indicating sheets are provided for embroidery stitching. The pattern indicating sheets represent the different unit patterns stored in the computer sewing machine respectively. Each of the unit patterns is provided with a reference cross mark 13*a* of crossed lines having the reference numerals 13*a* and 13*b* printed at the opposite ends thereof as shown in FIG. 4(*a*). The reference numerals 13*a* and 13*b* may be replaced by other marks such as ○ or x mark. Any marks may be used if the marks are regarded as being convenient for positioning the work to be embroidered.

As shown in FIGS. 1-3, the auxiliary table B is composed of a table 15 having the upper flat surface as already mentioned and a plurality of legs 16. The table 15 has a means C provided at a predetermined position thereof for holding the work positioning arm 10. The positioning arm 10 has the connecting part 12 connected to the holding means C.

Figure 6A:
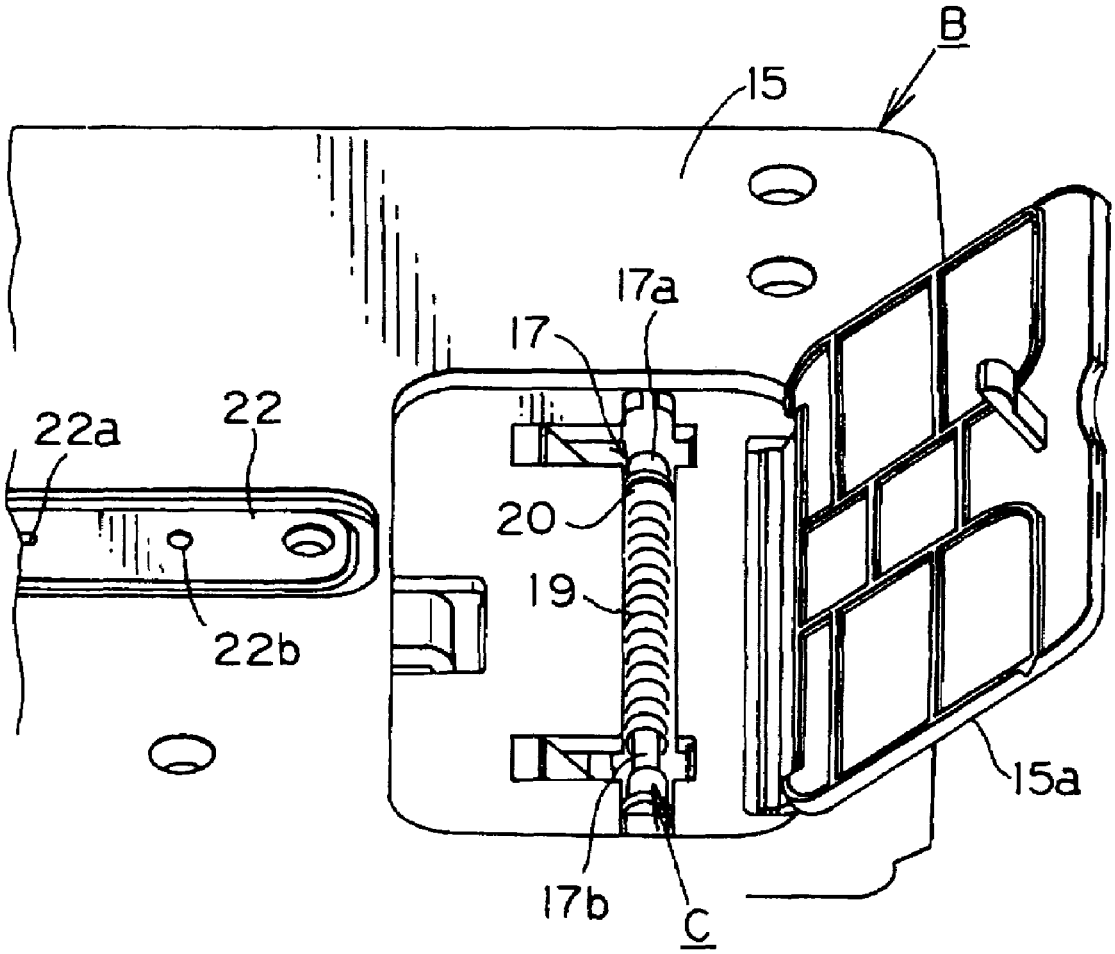
FIG. 6(*a*) is a perspective view of the auxiliary table showing a holding means with a cover being opened. (*b*) is a plan elevational view of the holding means shown as enlarged.
Figure 6B:
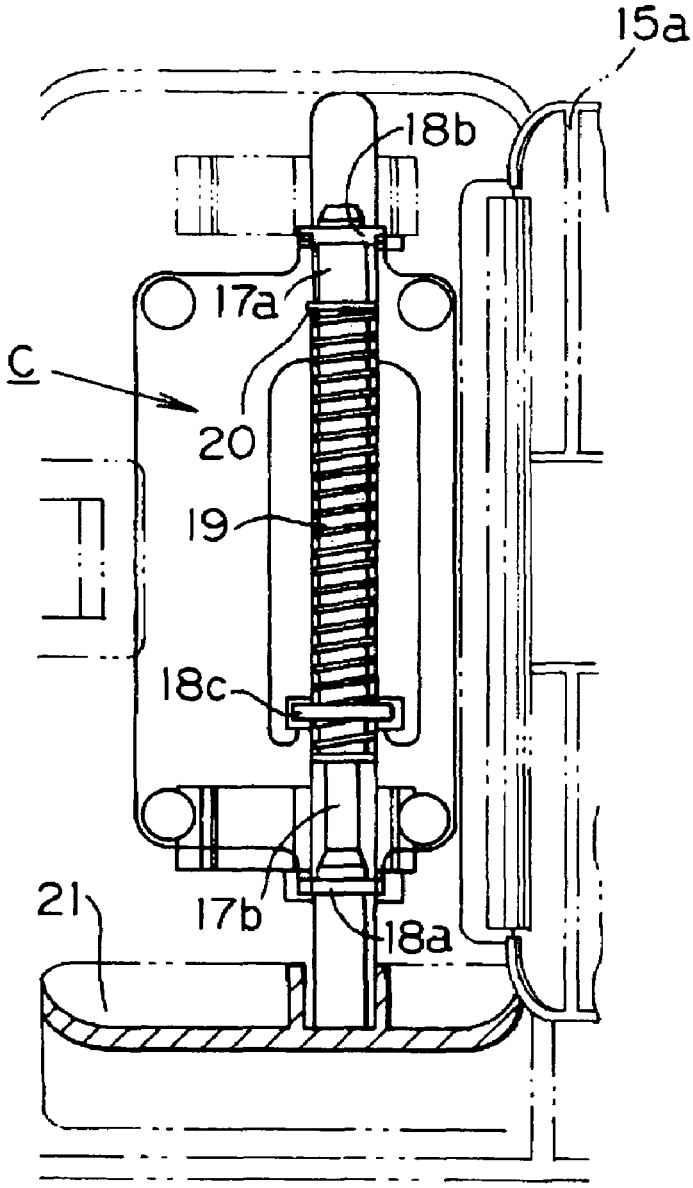
Figure 7:
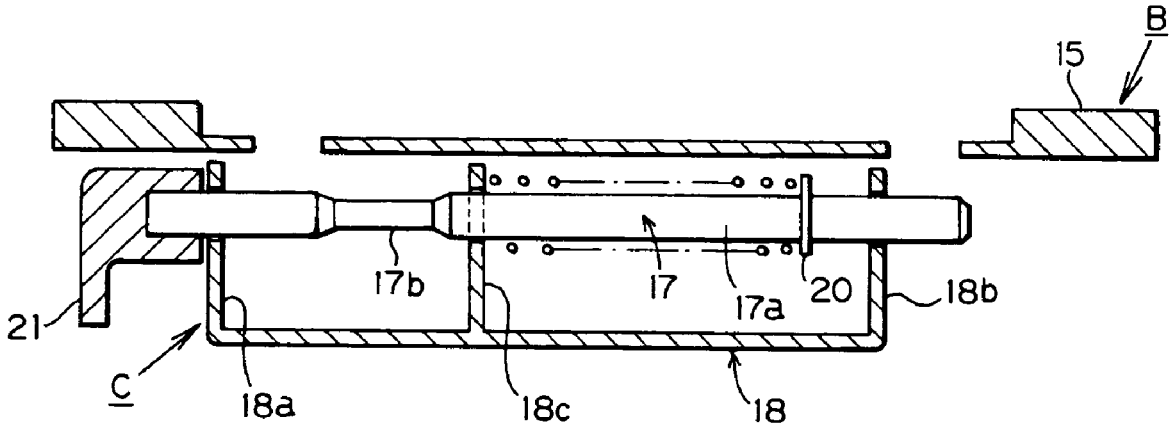
FIG. 7 is a side elevational view of the holding means shown partly in vertical section.

As shown in FIGS. 6 and 7, the holding means C includes a holding shaft 17, a support member 18 for supporting the holding shaft 17, a coil spring 19 and an operating lever 21. The support member 18 is formed with support portions 18*a*, 18*b* and an elasticity regulating portion 18*c* having holes respectively for turnably supporting the holding shaft 17.

As shown in FIG. 7, the holding shaft 17 is formed with a portion 17*a* which is of a diametrically predetermined thickness and a portion 17*b* which is of a diametrically reduced thickness. In other words, the holding shaft 17 which is of a diametrically predetermined thickness is partly reduced in diameter on one side of the axial direction. The holding shaft 17 supported on the support portions 18*a*, 18*b* and may be axially slidable. The coil spring 19 is arranged around the holding shaft 17 and between the support portion 18*a* and the elasticity regulating portion 18*c*. Precisely, the holding shaft 17 has a stopper washer 20 secured thereto, and the coil spring 19 is arranged between the stopper washer 20 and the elasticity regulating portion 18*c* as is compressed therebetween, wherein one end portion of the holding shaft 17 is normally protruded out of the support portion 18*b*.

On the other hand, the opposite end portion of the holding shaft 17 is also normally protruded out of the support portion 18*a* and has the operating lever 21 secured thereto. With the holding shaft 17 being supported on the support member 18, the diametrically reduced portion 17*b* is located between the support portion 18*a* and the elasticity regulating portion 18*c*. With such arrangement of the constituent elements, the holding shaft 17 may be slidingly moved in one direction by pulling the operating lever 21 against the spring action of the coil spring 19.

The support member 18 of the holding means C is fixed to the table 15 at the rear side thereof. As shown I FIG. 6(*a*), the table 15 has a hollowed or depressed part formed at the upper side thereof with a flat bottom provided. The flat bottom is partly cut out cut out so that the holding shaft 17 may be exposed thereat and may be accessed from the upper side of the table. The depressed part may be closed by a cover 15*a* when the work positioning operation is not conducted. When the opening is closed by the cover 15*a*, the cover 15*a* is flush with the upper surface of the table 15. Therefore, the table 15 may be used as an auxiliary table B in combination with the sewing machine as shown in FIG. 3(*b*). Incidentally, the cover 15*a* is connected to the table 15 by means of hinges or the like so that the cover 15*a* may be moved to close or open the opening. The cover 15*a* may be replaced by a cover which is separated from the table 15 and is fitted to or removed from the table 15 to close or open the opening.

On the other hand, the positioning arm 10 has the connecting part 12 which includes a pair of connecting portions 12*a*, 12*a* as shown in FIG. 4(*b*). One of the connecting portions 12*a*, 12*a* is formed with an axially slit ring 12*c* just like a letter C as shown in FIG. 4(*c*) and the other is formed with a ring 12*d* as shown in FIG. 4(*d*).

Figure 8A:
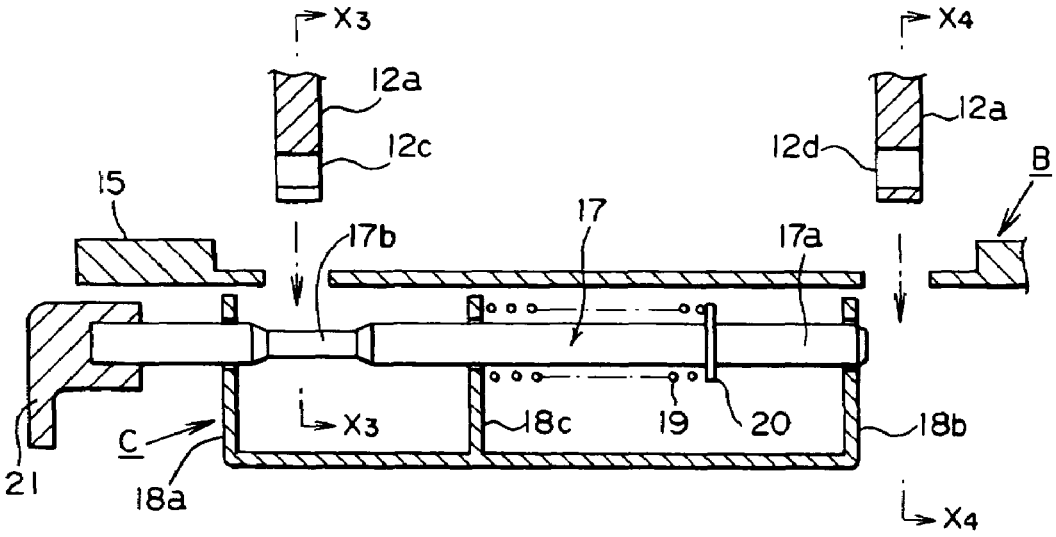
FIG. 8(*a*) is a side elevational view of the holding means shown partly in vertical section wherein the holding means is operated so as to allow the positioning arm to be connected thereto. (*b*) is a side elevational view taken from the arrow marks X3-X3 of (*a*), and (*c*) is a side elevational view taken from the arrow marks X4-X4 of (*a*).
Figure 8B:
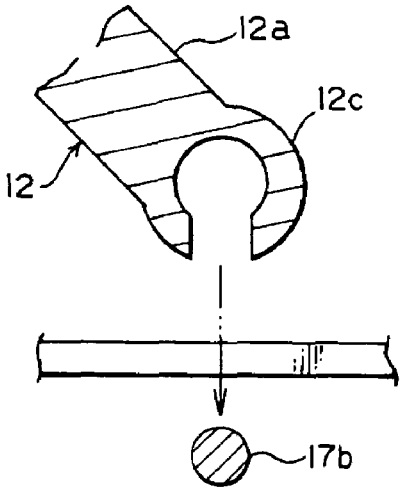
Figure 8C:
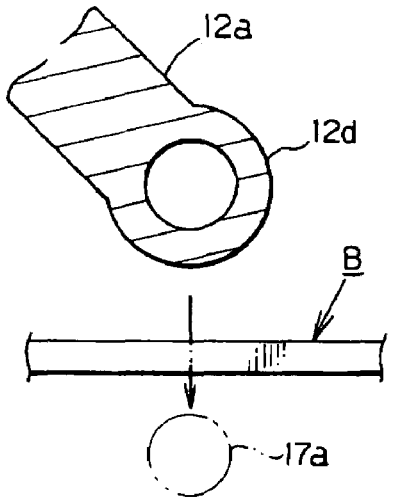

The positioning arm 10 is connected to the holding shaft 17 by axially moving the holding shaft 17 with respect to the connecting portions 12, 12 of the positioning arm 10. The axially slit ring 12*c* is connected to the holding shaft 17 at the diametrically reduced portion 17*b* as the axially slit ring 12*c* is moved radially of the reduced portion 17*b* as shown in FIG. 8(*b*) and FIG. 9(*b*). Firstly, the holding shaft 17 is axially pulled by the operating lever 21 against the spring action of the coil spring 19 and relative to the support member 8 in one direction from the position as shown in FIG. 7 to the position as shown in FIG. 8(*a*).

Figure 9A:
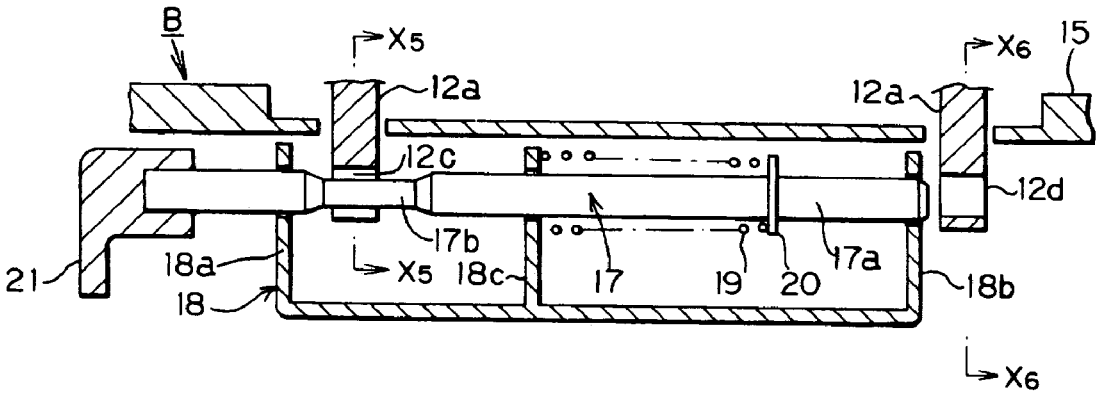
FIG. 9(*a*) is a side elevational view of the holding means shown partly in vertical section and showing a process of the positioning arm being connected to the holding means. (*b*) is a side elevational view taken from the arrow marks X5-X5 of (*a*), and (*c*) is a side elevational view taken from the arrow marks X6-X6 of (*a*).
Figure 9B:
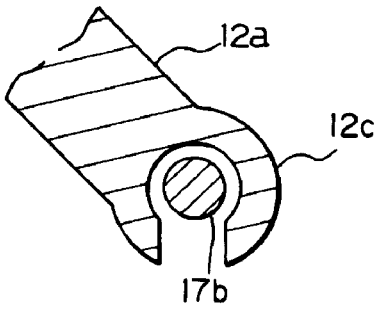
Figure 9C:
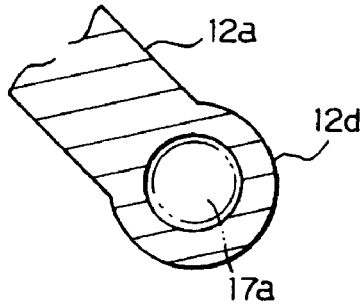
Figure 10A:
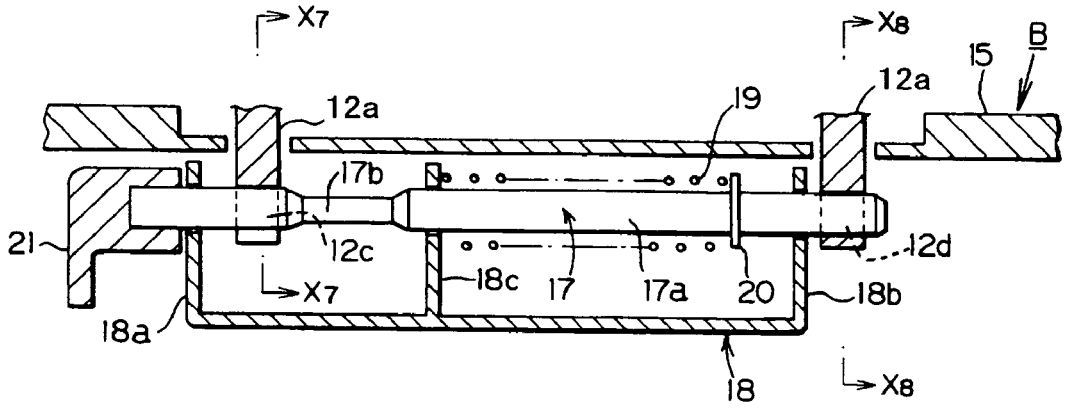
FIG. 10(*a*) is a side elevational view of the holding means shown partly in vertical section and showing the positioning arm having been connected to the holding means. (*b*) is a side elevational view taken from the arrow marks X7-X7 of (*a*), and (*c*) is a side elevational view taken from the arrow marks X8-X8 of (*a*).
Figure 10B:
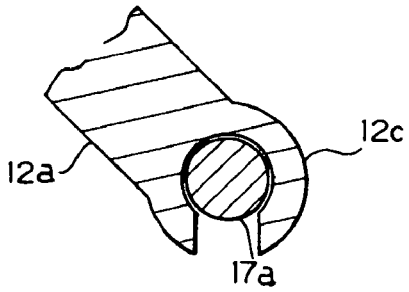
Figure 10C:
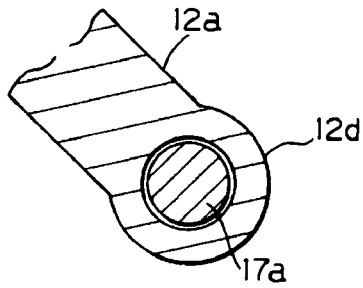

In this condition, the ring 12*d* of the connecting portion 12 may be located at the outside of the side 18*a* the support member 8 while the axially slit ring 12*c* of the connecting portion 12 may be located radially opposite to the axially reduced portion 17*b* of the holding shaft 17 where the axially slit ring 12*c* may enter in engagement with the axially reduced portion 17*b* at the slit as shown in FIGS. 8 and 9. Then with release of the operating lever 21, the holding shaft 17 is returned by the spring action of the coil spring 19 from the position as shown in FIG. 9 to the position as shown in FIG. 10 where the axially thicker portion 17*a* of the holding shaft 17 is inserted into the rings 12*c* and 12*d* of the connecting portions 12, 12.

Thus the positioning arm 10 may be connected to the holding means C of the auxiliary table B. In case the positioning arm 10 is removed from the auxiliary table B, the holding shaft 17 is again axially pulled by the operating lever 21 against the spring action of the coil spring 19 and relative to the support member 8 in one direction from the position as shown in FIG. 10 to the position as shown in FIG. 9 where the en 17*a* of the holding shaft 17 is disengaged from the ring 12*d* of the connecting portion 12 and the axially slit ring 12*c* is ready to be disengaged from the axially reduced portion 17*b* of the holding shaft 17. Thus the positioning arm 10 may be removed from the holding means C.

The table 15 has a portion 22 provided therewith for supporting the embroidery frame 7. The frame supporting portion 22 is formed with a threaded hole 22*a* and straight holes 22*b*, 22*b*, the straight holes being provided on both sides of the threaded hole 22*a* in one line. The position of the frame supporting portion 22 and the position of the positioning part 11 of the positioning arm 10 are set to be in accordance with the initialized position of the carriage 6 and the position of the work to be held by the embroidery frame 7 as will be described in detail.

Figure 5A:
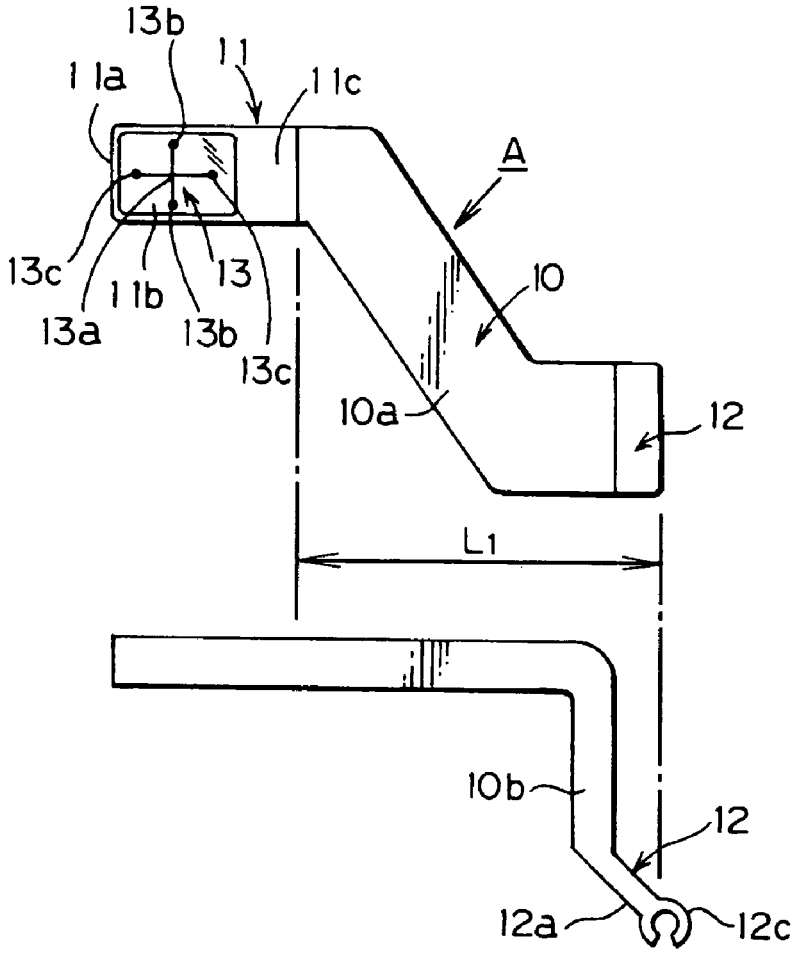
FIG. 5(*a*) is a plan elevational view of a longitudinally short type of work positioning arm and is a side elevational view of the short type of work positioning arm shown in set for convenience sake. (*b*) is a plan elevational view of a longitudinally long type of work positioning arm and is a side elevational view of the long type of work positioning arm shown in set for convenience sake.
Figure 5B:
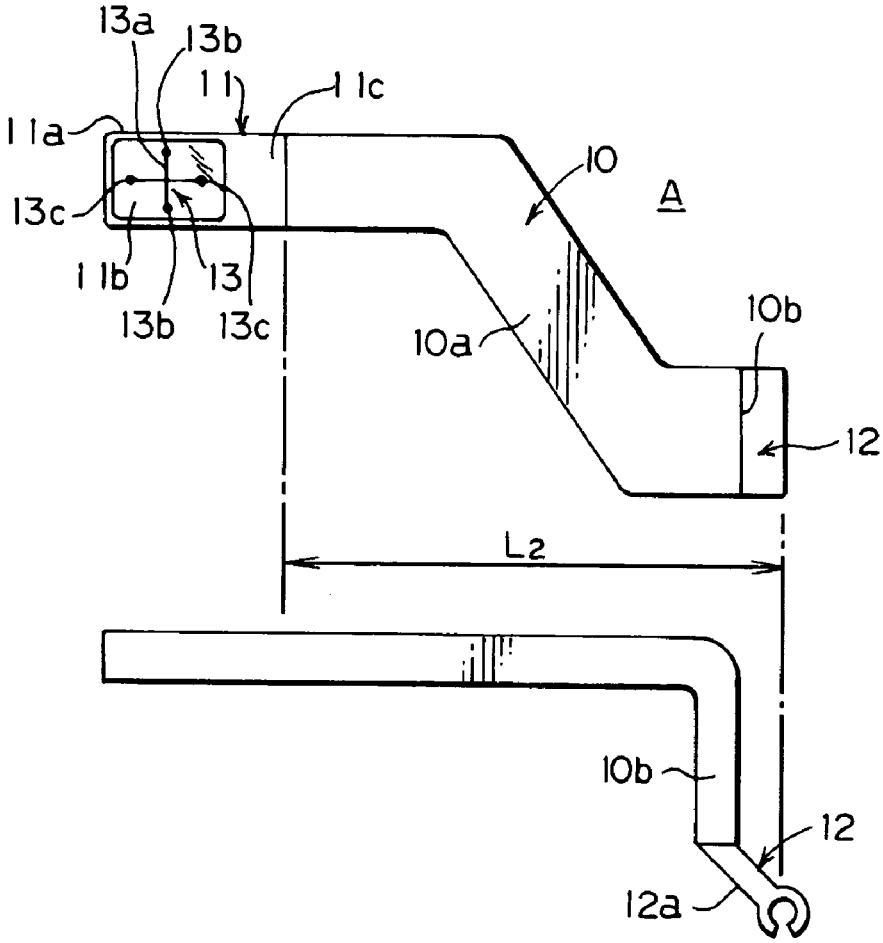

According to the invention, a plurality of frame supporting portions 22 may be provided on the table 15 so as to correspond to a plurality of embroidery frame attaching portions in case a plurality of embroidery frame attaching portions are provided at the carriage 6. Further, a plurality of holding means C may be provided in accordance with a plurality of embroidery frame attaching portions of the carriage 6. Further, a plurality of positioning arms 10 may be provided. For example, the axial length of the positioning arm 10 may be of a dimension L1 or may be of a longer one L2 as shown in FIG. 5(*a*), (*b*) for corresponding to a plurality of embroidery frame attaching portions of the carriage 6.

Figure 11A:
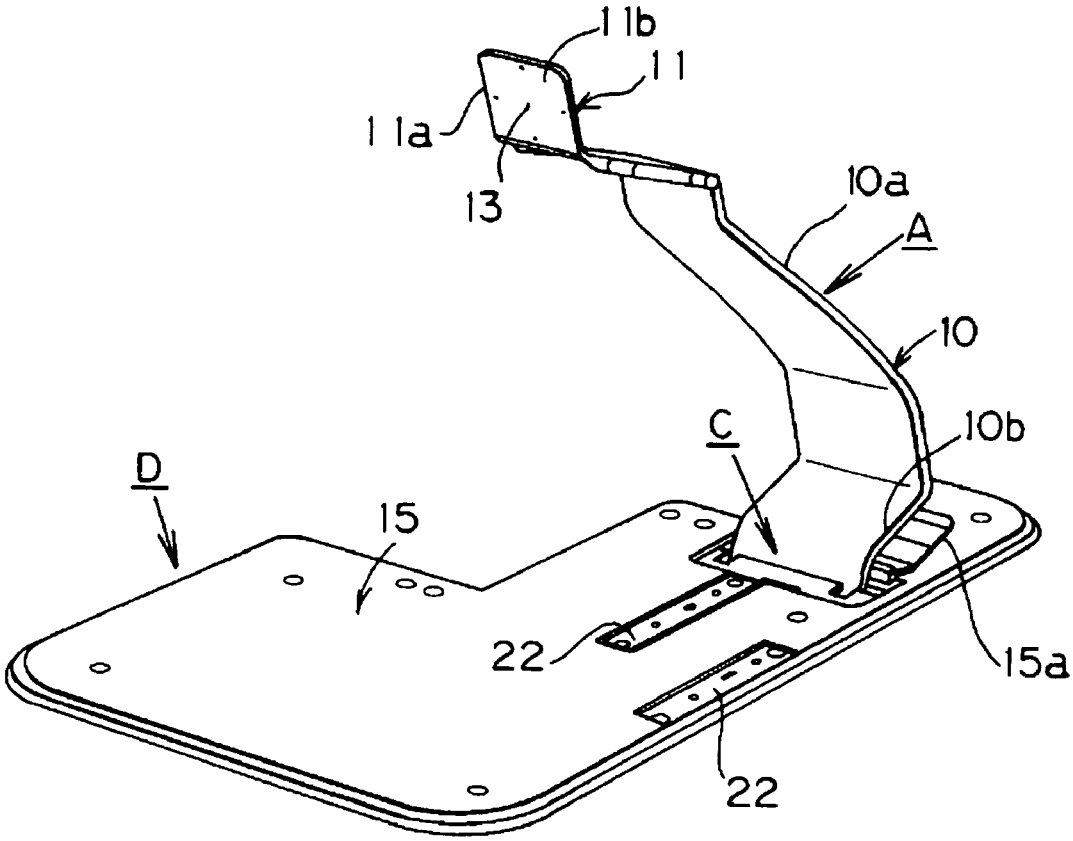
FIG. 11(*a*) is a perspective view of a work positioning device which is a second embodiment of the invention and is substantially composed of the work positioning arm and a table. (*b*) is a perspective view of the table from which the positioning arm is removed from the table.
Figure 11B:
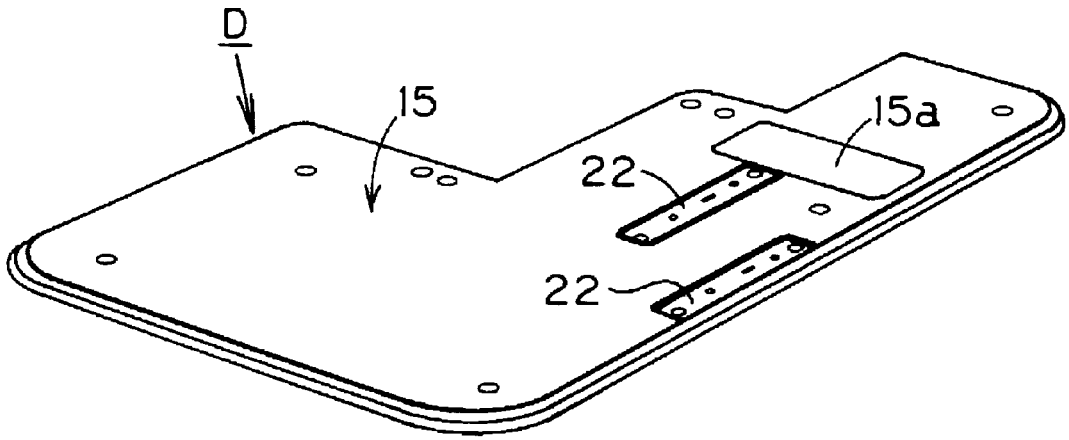
Figure 12:
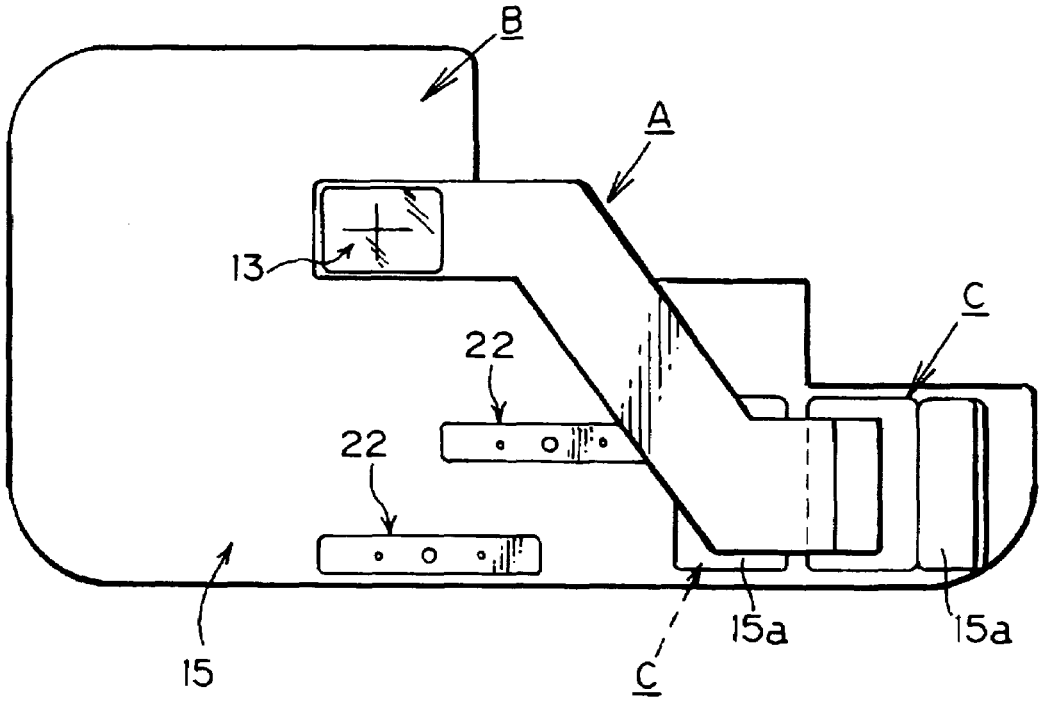
FIG. 12 is a plan elevational view of a work positioning device which is a third embodiment of the invention and has two holding means provided therewith.
Figure 13:
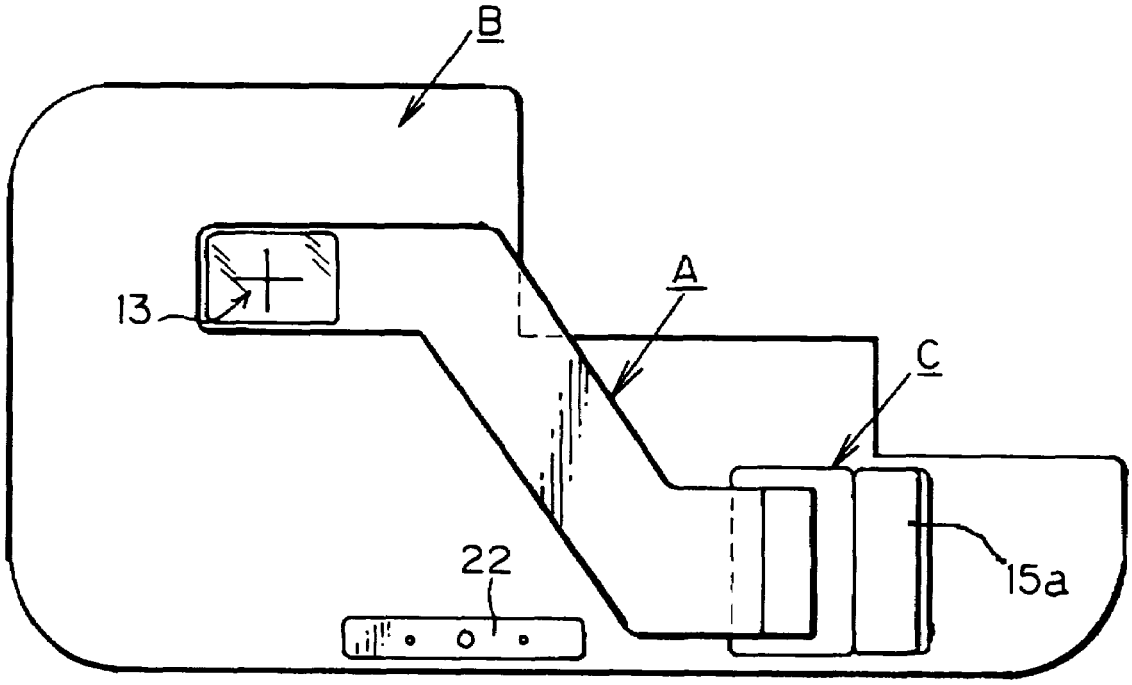
FIG. 13 is a plan elevational view of a work positioning device which is a fourth embodiment of the invention and has one holding means provided therewith.
Figure 14:
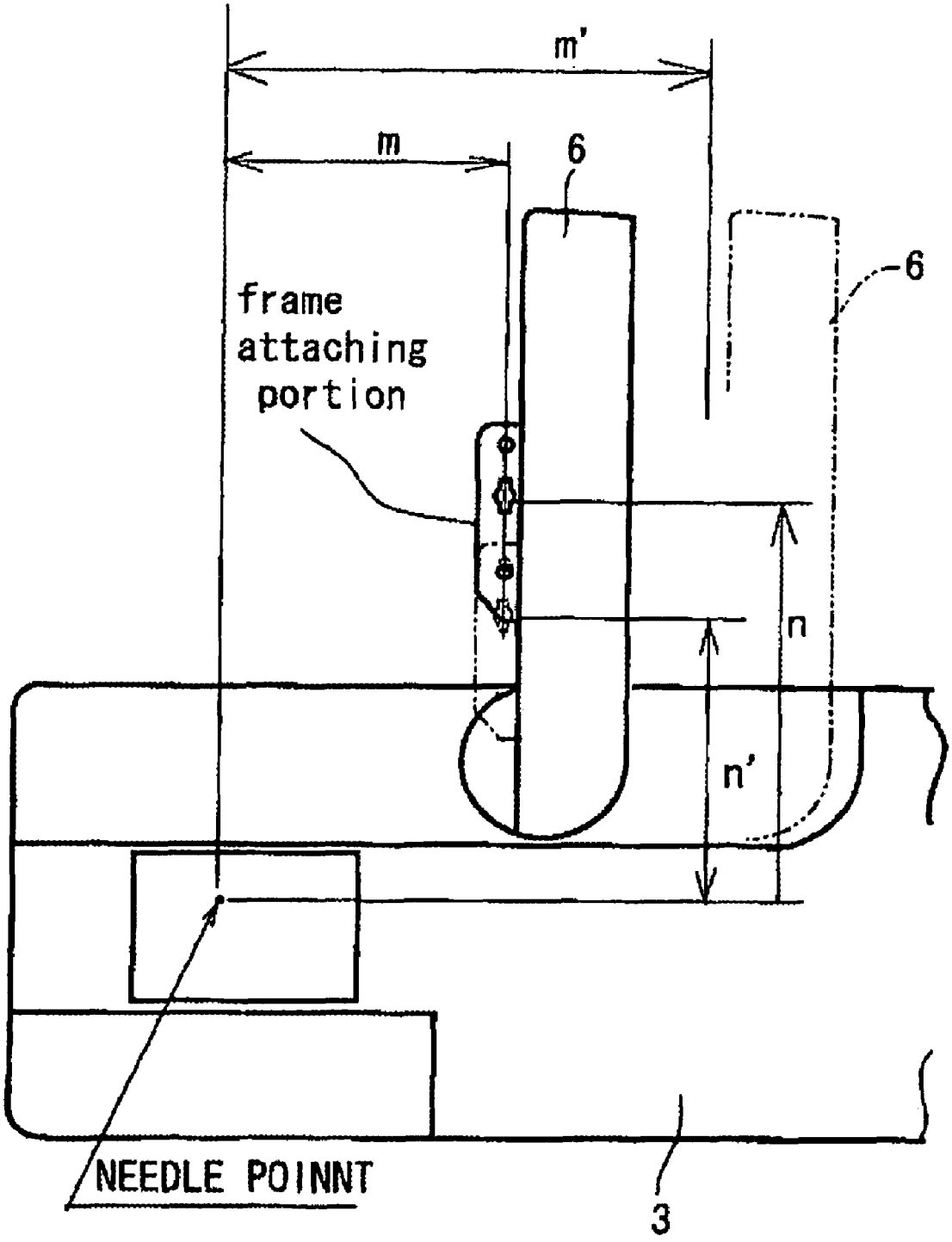
FIG. 14 is a plan elevational view of a work positioning device in accordance with an exemplaiy embodiment of the present invention.
Figure 15:
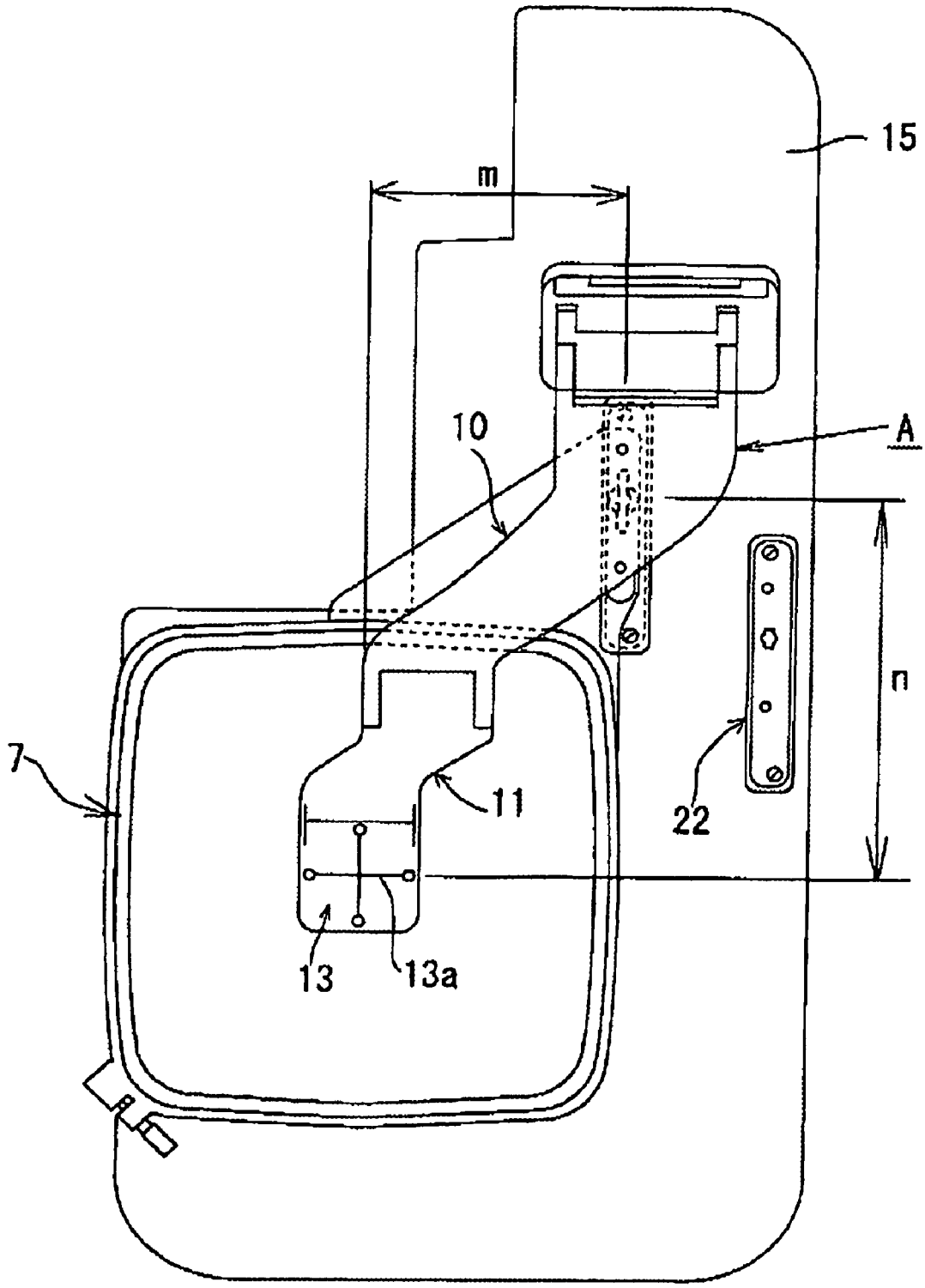
FIG. 15 is a plan elevational view of a work positioning device in accordance with an exemplary embodiment of the present invention.
Figure 16:
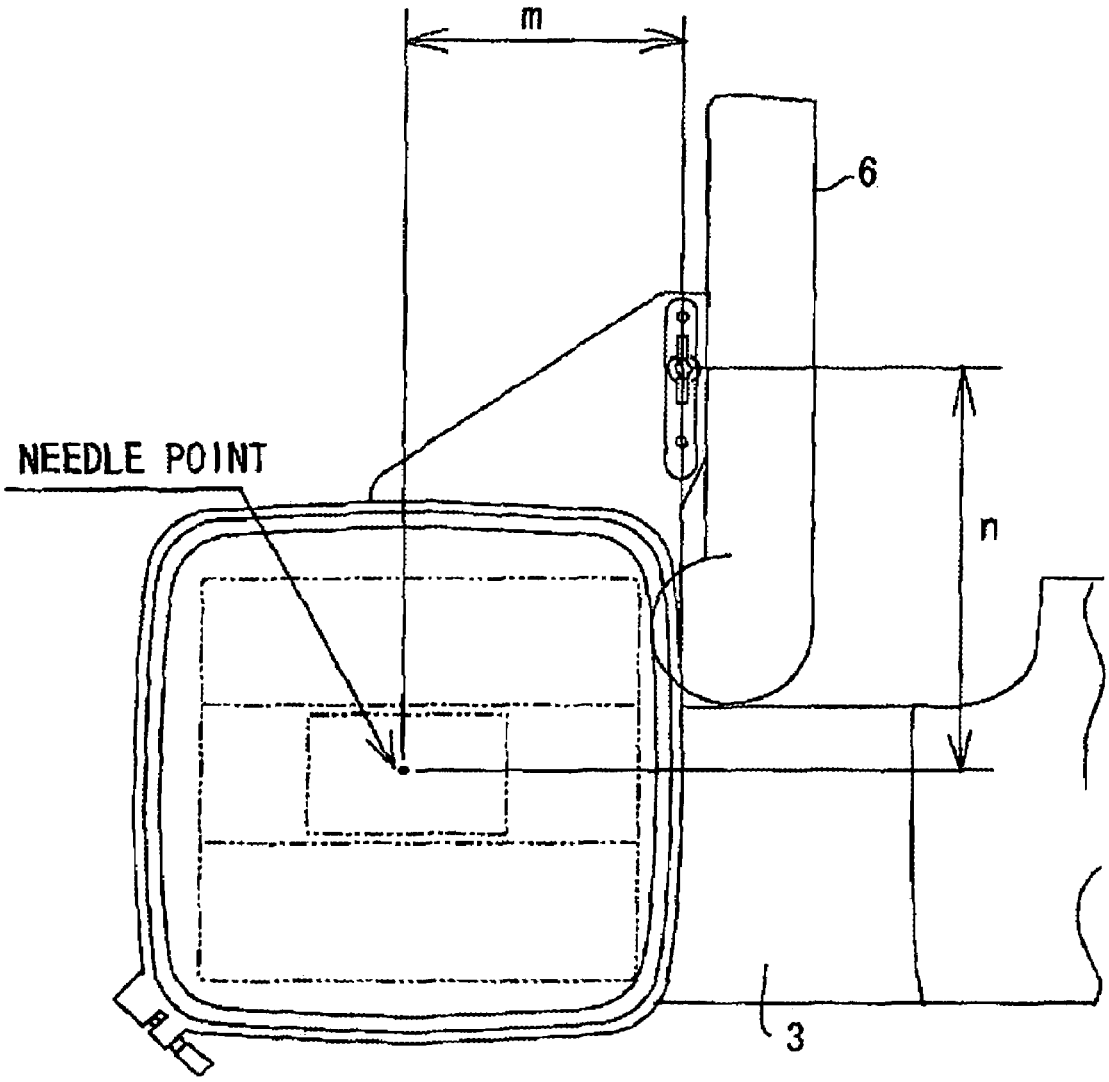
FIG. 16 is a plan elevational view of a work positioning device in accordance with an exemplary embodiment of the present invention.

Further, the positioning arm 10 may be fixed to the table 15 by hook means provided on the rear side of the table 15. Further, FIG. 11(*a*) shows a table D having the positioning arm 10 removably connected, the table D having no legs in contrast to the table 15 having a plurality of legs 16. The positioning arm 10 and the holding means C provided on the table D are substantially same with those of the table 15. FIG. 11(*b*) shows the table D having the positioning arm 10 removed therefrom.

Subsequently, the method will be described for stitching an optional embroidery pattern at an optional position of the work W held by the embroidery frame 7. Firstly, one pattern indicating sheet is optionally selected from a plurality of different pattern indicating sheet. The unit pattern of the selected pattern indicating sheet is placed on an optional position of the work W. Then marks are given to the work W through the mark holes 13*b*, 13*c* at the opposite ends of the crossed lines 13*a* of the reference mark 13. Then the pattern indicating sheet is removed from the work and the given marks are connected with straight lines to make a mark of crossed lines.

Subsequently, the positioning arm 10 is turned up and the embroidery frame 7 is attached to the frame attaching portion 22 of the table 15 as shown in FIG. 2(*a*) by means of pins provided on the neck 8 of the embroidery frame 7 inserted into the straight holes 22*b*, 22*b* of the frame attaching portion 22 respectively and my means of a center screw 24 of the neck 8 screwed into the threaded hole 22*a* of the frame attaching portion 22.

Subsequently, the work W with the mark of crossed lines being given is placed on the embroidery frame 7 with the mark of crossed lines being located within the frame 7. Then the positioning arm 10 is turned down and the position of the work W is adjusted to make the mark of crossed lines come in accord with the reference mark 13 of the transparent window 11*b* of the positioning arm 10. Then the work W is set to the embroidery frame 7 in a tightened condition by the inner frame 9 which is fitted to the inside of the frame 7 with the mark of crossed lines of the work W being in accord with the reference mark 13 of the transparent window 11*b* the positioning arm 10 as shown in FIG. 2(*b*).

Thus according to the invention, the positioning arm 10 may be used to position an optionally selected one of a plurality of different patterns of pattern indicating sheets to an optional position of the work W where the selected pattern is embroidered. Subsequently, the pattern which is same with the pattern selected from the pattern indicating sheets may be selected from the patterns stored in the memory of the computer sewing machine. The pattern data selectively read out of the memory of the sewing machine will control the movement of the embroidery frame relative to the machine needle which is vertically reciprocated to form stitches in cooperation with the loop taker. Thus the selected pattern of pattern indicating sheet may be automatically stitched on the work W held by the embroidery frame.

After the selected pattern is stitched up, the work W is removed from the embroidery frame 7 and another pattern may be stitched at another position of the work W in the same way as was taken in connection with stitching the precededly selected pattern. In this way, a plurality of unit patterns may be embroidered in combination on a same work W. As the result, a large sized pattern may be embroidered.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A work positioning device for a computer sewing machine having a memory for storing therein a pattern data of a plurality of different embroidery patterns which are selectively read out of the memory to drive a carriage of the sewing machine carrying an embroidery frame holding a work to be embroidered, thereby to control an operation of the embroidery frame relative to a machine needle, the embroidery frame being set to an initialized position prior to starting an embroidery stitching operation, said work positioning device comprising:

an auxiliary table of the computer sewing machine having a portion provided therewith for supporting said embroidery frame, said frame supporting portion of the auxiliary table corresponding to one of a plurality of positions of said carriage;

a positioning arm having one end removably and turnably connected to a holding means provided on said auxiliary table, said positioning arm having a positioning part provided at an opposite end for positioning said work so that a selected pattern may be stitched at an optional position of said work;

said positioning arm being movable between an upper position where said positioning part is spaced from an upper surface of said auxiliary table and a lower position where said positioning part is in contact with the upper surface of said auxiliary table;

said positioning part having a reference mark of crossed lines provided thereat, said reference mark showing a an initialized position for starting a pattern stitching operation when said embroidery frame is connected to said carriage;

said work having a mark of crossed lines provided at an optional position thereof, said mark of crossed lines being put upon said reference mark of crossed lines of said positioning part so that the mark of crossed lines come in accord with said reference mark, thereby to confirm a position of said work to be held by said embroidery frame, the position of said work corresponding to the initialized position that is one of a plurality of frame supporting positions of said carriage, while said embroidery frame is connected to said frame supporting portion of said auxiliary table.

2. The work positioning device as defined in claim 1, wherein said positioning part includes a transparent plate having said reference mark of crossed lines provided thereat showing the initialized position for starting the pattern stitching operation when said embroidery frame is connected to said carriage of the sewing machine.

3. A work positioning device for a computer sewing machine having a memory for storing therein a pattern data of a plurality of different embroidery patterns which are selectively read out of the memory to drive a carriage of the sewing machine carrying an embroidery frame holding a work to be embroidered, thereby to control an operation of the embroidery frame relative to a machine needle, the embroidery frame being set to an initialized position prior to starting an embroidery stitching operation, said work positioning device comprising:

a table having a portion provided therewith for supporting said embroidery frame, said frame supporting portion of the table corresponding to one of a plurality of positions of said carriage;

a positioning arm having one end removably and turnably connected to a holding means provided on said table, said positioning arm having a positioning part provided at an opposite end for positioning said work so that a selected pattern may be stitched at an optional position of said work;

said positioning arm being movable between an upper position where said positioning part is spaced from an upper surface of said table and a lower position where said positioning part is in contact with the upper surface of said table;

said positioning part having a reference mark of crossed lines provided thereat, said reference mark showing a an initialized position for starting a pattern stitching operation when said embroidery frame is connected to said carriage;

said work having a mark of crossed lines provided at an optional position thereof, said mark of crossed lines being put upon said reference mark of crossed lines of said positioning part so that the mark of crossed lines may come in accord with said reference mark, thereby to confirm a position of said work to be held by said embroidery frame, the position of said work corresponding to the initialized position that is one of a plurality of frame supporting positions of said carriage, while said embroidery frame is connected to said frame supporting portion of said table.

4. The work positioning device as defined in claim 3, wherein said positioning part includes a transparent plate having said reference mark of crossed lines provided thereat showing the initialized position for starting the pattern stitching operation when said embroidery frame is connected to said carriage of the sewing machine.

5. A work positioning device for a computer sewing machine having a memory for storing therein a pattern data of a plurality of different embroidery patterns which are selectively read out of the memory to drive a carriage of the sewing machine carrying an embroidery frame holding a work to be embroidered, thereby to control an operation of the embroidery frame relative to a machine needle, the embroidery frame being set to an initialized position prior to starting an embroidery stitching operation, said work positioning device comprising:

an auxiliary table of the computer sewing machine having a portion provided therewith for supporting said embroidery frame, said frame supporting portion of the auxiliary table corresponding to one of a plurality of positions of said carriage:

a positioning arm having one end removably and turnably connected to a holding means provided on said auxiliary table, said positioning arm having a positioning part provided at an opposite end for positioning said work so that a selected pattern may be stitched at an optional position of said work:

said positioning arm being movable between an upper position where said positioning part is spaced from an upper surface of said auxiliary table and a lower position where said positioning part is in contact with the upper surface of said auxiliary table;

said positioning part having a reference mark of crossed lines provided thereat, said reference mark showing a an initialized position for starting a pattern stitching operation when said embroidery frame is connected to said carriage;

said work having a mark of crossed lines provided at an optional position thereof, said mark of crossed lines being put upon said reference mark of crossed lines of said positioning part so that the mark of crossed lines come in accord with said reference mark, thereby to confirm a position of said work to be held by said embroidery frame, the position of said work corresponding to the initialized position of said carriage, while said embroidery frame is connected to said frame supporting portion of said auxiliary table, wherein said frame supporting portion comprises a plurality of numbers in accordance with the number of said frame attaching portion provided at said carriage.

6. A work positioning device for a computer sewing machine having a memory for storing therein a pattern data of a plurality of different embroidery patterns which are selectively read out of the memory to drive a carriage of the sewing machine carrying an embroidery frame holding a work to be embroidered, thereby to control an operation of the embroidery frame relative to a machine needle, the embroidery frame being set to an initialized position prior to starting an embroidery stitching operation, said work positioning device comprising;

an auxiliary table of the computer sewing machine having a portion provided therewith for supporting said embroidery frame, said frame supporting portion of the auxiliary table corresponding to one of a plurality of positions of said carriage;

a positioning arm having one end removably and turnably connected to a holding means provided on said auxiliary table, said positioning arm having a positioning part provided at an opposite end for positioning said work so that a selected pattern may be stitched at an optional position of said work;

said positioning arm being movable between an upper position where said positioning part is spaced from an upper surface of said auxiliary table and a lower position where said positioning part is in contact with the upper surface of said auxiliary table;

said positioning part having a reference mark of crossed lines provided thereat, said reference mark showing a an initialized position for starting a pattern stitching operation when said embroidery frame is connected to said carriage;

said work having a mark of crossed lines provided at an optional position thereof, said mark of crossed lines being put upon said reference mark of crossed lines of said positioning part so that the mark of crossed lines come in accord with said reference mark, thereby to confirm a position of said work to be held by said embroidery frame, the position of said work corresponding to the initialized position of said carriage, while said embroidery frame is connected to said frame supporting portion of said auxiliary table, wherein said positioning arm holding means comprises a plurality of numbers in accordance with the number of said frame attaching portion provided at said carriage.

7. A work positioning device for a computer sewing machine having p memory for storing therein a pattern data of a plurality of different embroidery patterns which are selectively read out of the memory to drive a carriage of the sewing machine carrying an embroidery frame holding a work to be embroidered, thereby to control an operation of the embroidery frame relative to a machine needle, the embroidery frame being set to an initialized position prior to starting an embroidery stitching operation, said work positioning device comprising:

an auxiliary table of the computer sewing machine having a portion provided therewith for supporting said embroidery frame, said frame supporting portion of the auxiliary table corresponding to one of a plurality of positions of said carriage;

a positioning arm having one end removably and turnably connected to a holding means provided on said auxiliary table, said positioning arm having a positioning part provided at an opposite end for positioning said work so that a selected pattern may be stitched at an optional position of said work;

said positioning arm being movable between an upper position where said positioning part is spaced from an upper surface of said auxiliary table and a lower position where said positioning part is in contact with the upper surface of said auxiliary table;

said positioning part having a reference mark of crossed lines provided thereat, said reference mark showing a an initialized position for starting a pattern stitching operation when said embroidery frame is connected to said carriage;

said work having a mark of crossed lines provided at an optional position thereof, said mark of crossed lines being put upon said reference mark of crossed lines of said positioning part so that the mark of crossed lines come in accord with said reference mark, thereby to confirm a position of said work to be held by said embroidery frame, the position of said work corresponding to the initialized position of said carriage, while said embroidery frame is connected to said frame supporting portion of said auxiliary table, wherein said positioning arm comprises a plurality of numbers in accordance with the number of said frame attaching portion provided at said carriage.

8. A work positioning device for a computer sewing machine having a memory for storing therein a pattern data of a plurality of different embroidery patterns which are selectively read out of the memory to drive a carriage of the sewing machine carrying an embroidery frame holding a work to be embroidered, thereby to control an operation of the embroidery frame relative to a machine needle, the embroidery frame being set to an initialized position prior to starting an embroidery stitching operation, said work positioning device comprising:

an auxiliary table of the computer sewing machine having a portion provided therewith for supporting said embroidery frame, said frame supporting portion of the auxiliary table corresponding to one of a plurality of positions of said carriage;

a positioning arm having one end removably and turnably connected to a holding means provided on said auxiliary table, said positioning arm having a positioning part provided at an opposite end for positioning said work so that a selected pattern may be stitched at an optional position of said work;

said positioning arm being movable between an upper position where said positioning part is spaced from an upper surface of said auxiliary table and a lower position where said positioning part is in contact with the upper surface of said auxiliary table;

said positioning part having a reference mark of crossed lines provided thereat, said reference mark showing a an initialized position for starting a pattern stitching operation when said embroidery frame is connected to said carriage;

said work having a mark of crossed lines provided at an optional position thereof, said mark of crossed lines being put upon said reference mark of crossed lines of said positioning part so that the mark of crossed lines come in accord with said reference mark, thereby to confirm a position of said work to be held by said embroidery frame, the position of said work corresponding to the initialized position of said carriage, while said embroidery frame is connected to said frame supporting portion of said auxiliary table, wherein said positioning arm is positionally adjustable to a plurality of frame attaching portions provided at said carriage.

9. A work positioning device for a computer sewing machine having a memory for storing therein a pattern data of a plurality of different embroidery patterns which are selective read out of the memory to drive a carriage of the sewing machine carrying an embroidery frame holding a work to be embroidered, thereby to control an operation of the embroidery frame relative to a machine needle, the embroidery frame being set to an initialized position prior to starting an embroidery stitching operation, said work positioning device comprising:

a table having a portion provided therewith for supporting said embroidery frame, said frame supporting portion of the table corresponding to one of a plurality of positions of said carriage;

a positioning arm having one end removably and turnably connected to a holding mean provided on said table, said positioning arm having a positioning part provided at an opposite end for positioning said work so that a selected pattern may be stitched at an optional position of said work;

said positioning arm being movable between an upper position where said positioning part is spaced from an upper surface of said table and a lower position where said positioning part is in contact with the upper surface of said table;

said positioning part having a reference mark of crossed lines provided thereat, said reference mark showing a an initialized position for starting a pattern stitching operation when said embroidery frame is connected to said carriage;

said work having a mark of crossed lines provided at an optional position thereof, said mark of crossed lines being put upon said reference mark of crossed lines of said positioning part so that the mark of crossed lines may come in accord with said reference mark, thereby to confirm a position of said work to be held by said embroidery frame, the position of said work corresponding to the initialized position of said carriage, while said embroidery frame is connected to said frame supporting portion of said table, wherein said frame supporting portion comprises a plurality of numbers in accordance with the number of said frame attaching portion provided at said carriage.

10. A work positioning device for a computer sewing machine having a memory for storing therein a pattern data of a plurality of different embroidery patterns which are selectively read out of the memory to drive a carriage of the sewing machine carrying an embroidery frame holding a work to be embroidered, thereby to control an operation of the embroidery frame relative to a machine needle, the embroidery frame being set to art initialized position prior to starting an embroidery stitching operation, said work positioning device comprising:

an auxiliary table of the computer sewing machine having a portion provided therewith for supporting said embroidery frame, said frame supporting portion of the auxiliary table corresponding to one of a plurality of positions of said carriage;

a positioning arm having one end removably and turnably connected to a holding means provided on said auxiliary table, said positioning arm having p positioning part provided at an opposite end for positioning said work so that a selected pattern may be stitched at an optional position of said work;

said positioning arm being movable between an upper position where said positioning part is spaced from an upper surface of said auxiliary table and a lower position where said positioning part is in contact with the upper surface of said auxiliary table;

said positioning part having a reference mark of crossed lines provided thereat, said reference mark showing a an initialized position for starting a pattern stitching operation when said embroidery frame is connected to said carriage;

said work having a mark of crossed lines provided at an optional position thereof, said mark of crossed lines being put upon said reference mark of crossed lines of said positioning part so that the mark of crossed lines come in accord with said reference mark, thereby to confirm a position of said work to be held by said embroidery frame, the position of said work corresponding to the initialized position of said carriage, while said embroidery frame is connected to said frame supporting portion of said auxiliary table, wherein said positioning part includes a transparent plate having said reference mark of crossed lines provided thereat showing the initialized position for starting the pattern stitching operation when said embroidery frame is connected to said carriage of the sewing machine, and wherein said frame supporting portion comprises a plurality of numbers in accordance with the number of said frame attaching portion provided at said carriage.

11. A work positioning device for a computer sewing machine having a memory for storing therein a pattern data of a plurality of different embroidery patterns which are selectively read out of the memory to drive a carriage of the sewing machine carrying an embroidery frame holding a work to be embroidered, thereby to control an operation of the embroidery frame relative to a machine needle, the embroidery frame being set to an initialized position prior to starting an embroidery stitching operation, said work positioning device comprising:

a table having portion provided therewith for supporting said embroidery frame, said frame supporting portion of the table corresponding to one of a plurality of positions or said carriage;

a positioning arm having one end removably and turnably connected to a holding means provided on said table, said positioning arm having a positioning part provided at an opposite end for positioning said work so that a selected pattern may be stitched at an optional position of said work;

said positioning arm being movable between an upper position where said positioning part is spaced from an upper surface of said table and a lower position where said positioning part is in contact with the upper surface of said table;

said positioning part having a reference mark of crossed lines provided thereat, said reference mark showing a an initialized position for starting a pattern stitching operation when said embroidery frame is connected to said carriage;

said work having a mark of crossed lines provided at an optional position thereof, said mark of crossed lines being put upon said reference mark of crossed lines of said positioning part so that the mark of crossed lines may come in accord with said reference mark, thereby to confirm a position of said work to be held by said embroidery frame, the position of said work corresponding to the initialized position of said carriage, while said embroidery frame is connected to said frame supporting portion of said table, wherein said positioning arm holding means is provided in a plurality of numbers in accordance with the number of said frame attaching portion provided at said carriage.

12. A work positioning device for a computer sewing machine having a memory for storing therein a pattern data of a plurality of different embroidery patterns which are selectively read out of the memory to drive a carriage of the sewing machine carrying an embroidery frame holding a work to be embroidered, thereby to control an operation of the embroidery frame relative to a machine needle, the embroidery frame being set to an initialized position prior to starting an embroidery stitching operation, said work positioning device comprising:

an auxiliary table of the computer sewing machine having a portion provided therewith for supporting said embroidery frame, said frame supporting portion of the auxiliary table corresponding to one of a plurality of positions of said carriage;

a positioning arm having one end removably and turnably connected to a holding means provided on said auxiliary table, said positioning arm having a positioning part provided at an opposite end for positioning said work so that a selected pattern may be stitched at an optional position of said work;

said positioning arm being movable between an upper position where said positioning part is spaced from an upper surface of said auxiliary table and a lower position where said positioning part is in contact with the upper surface of said auxiliary table;

said positioning part having a reference mark of crossed lines provided thereat, said reference mark showing a an initialized position for starting a pattern stitching operation when said embroidery frame is connected to said carriage;

said work having a mark of crossed lines provided at an optional position thereof, said mark of crossed limes being put upon said reference mark of crossed lines of said positioning part so that the mark of crossed lines come in accord with said reference mark thereby to confirm a position of said work to be held by said embroidery frame, the position of said work corresponding to the initialized position of said carriage, while said embroidery frame is connected to said frame supporting portion of said auxiliary table, wherein said positioning part includes a transparent plate having said reference mark of crossed lines provided thereat showing the initialized position for starting the pattern stitching operation when said embroidery frame is connected to said carriage of the sewing machine, and wherein said positioning arm holding means comprises a plurality of numbers in accordance with the number of said frame attaching portion provided at said carriage.

13. A work positioning device for a computer sewing machine having a memory for storing therein a pattern data of a plurality of different embroidery patterns which are selectively read out of the memory to drive a carriage of the sewing machine carrying an embroidery frame holding a work to be embroidered, thereby to control an operation of the embroidery frame relative to machine needle, the embroidery frame being set to an initialized position prior to starting an embroidery stitching operation, said work positioning device comprising:

a table having a portion provided therewith for supporting said embroidery flame, said frame supporting portion of the table corresponding to one of a plurality of positions of said carriage;

a positioning arm having one end removably and turnably connected to a holding means provided on said table, said positioning arm having a positioning part provided at an opposite end for positioning said work so that a selected pattern may be stitched at an optional position of said work;

said positioning arm being movable between an upper position where said positioning part is spaced from an upper surface of said table and a lower position where said positioning part is in contact with the upper surface of said table;

said positioning part having a reference mark of crossed lines provided thereat, said reference mark showing a an initialized position for starting a pattern stitching operation when said embroidery frame is connected to said carriage;

said work having a mark of crossed lines provided at an optional position thereof, said mark of crossed lines being put upon said reference mark of crossed lines of said positioning part so that the mark of crossed lines may come in accord with said reference mark, thereby to confirm a position of said work to beheld by said embroidery frame, the position of said work corresponding to the initialized position of said carriage, while said embroidery frame is connected to said frame supporting portion of said table, wherein said positioning arm comprises a plurality of numbers in accordance with the number of said frame attaching portion provided at said carriage.

14. A work positioning device for a computer sewing machine having a memory for storing therein a pattern data of a plurality of different embroidery patterns which are selectively read out of the memory to drive a carriage of the sewing machine carrying an embroidery frame holding a work to be embroidered, thereby to control an operation of the embroidery frame relative to a machine needle, the embroidery frame being set to an initialized position prior to starting an embroidery stitching operation, said work positioning device comprising:

an auxiliary table of the computer sewing machine having a portion provided therewith for supporting said embroidery frame, said frame supporting portion of the auxiliary table corresponding to one of a plurality of positions of said carriage;

a positioning arm having one end removably and turnably connected to a holding means provided on said auxiliary table, said positioning arm having a positioning part provided at an opposite end for positioning said work so that a selected pattern may be stitched at an optional position of said work;

said positioning arm being movable between an upper position where said positioning part is spaced from an upper surface of said auxiliary table and a lower position where said positioning pad is in contact with the upper surface of said auxiliary table;

said positioning part having a reference mark of crossed lines provided thereat, said reference mark showing a an initialized position for starting a pattern stitching operation when said embroidery frame is connected to said carriage;

said work having a mark of crossed lines provided at an optional position thereof, said mark of crossed lines being put upon said reference mark of crossed lines of said positioning part so that the mark of crossed lines come in accord with said reference mark, thereby to confirm a position of said work to be held by said embroidery frame, the position of said work corresponding to the initialized position of said carriage, while said embroidery frame is connected to said frame supporting portion of said auxiliary table, wherein said positioning part includes a transparent plate having said reference mark of crossed lines provided thereat showing the initialized position for starting the pattern stitching operation when said embroidery frame is connected to said carriage of the sewing machine, and wherein said positioning arm comprises a plurality of numbers in accordance with the number of said frame attaching portion provided at said carriage.

15. A work positioning device for a computer sewing machine having a memory for storing therein a pattern data of a plurality of different embroidery patterns which are selectively read out of the memory to drive a carriage of the sewing machine carrying an embroidery frame holding a work to be embroidered, thereby to control an operation of the embroidery frame relative to a machine needle, the embroidery frame being set to an initialized position prior to starting an embroidery stitching operation, said work positioning device comprising:

a table having a portion provided therewith for supporting said embroidery frame, said frame supporting portion of the table corresponding to one of a plurality of positions of said carriage;

a positioning arm having one end removably and turnably connected to a holding means provided on said table, said positioning arm having positioning part provided at an opposite end for positioning said work so that a selected pattern may be stitched at an optional position of said work;

said positioning arm being movable between an upper position where said positioning part is spaced from an upper surface of said table and a lower position where said positioning part is in contact with the upper surface of said table;

said positioning part having a reference mark of crossed lines provided thereat, said reference mark showing a an initialized position for starting a pattern stitching operation when said embroidery frame is connected to said carriage;

said work having a mark of crossed lines provided at an optional position thereof, said mark of crossed lines being put upon said reference mark of crossed lines of said positioning part so that the mark of crossed lines may come in accord with said reference mark, thereby to confirm a position of said work to be held by said embroidery frame, the position of said work corresponding to the initialized position of said carriage, while said embroidery frame is connected to said frame supporting portion of said table, wherein said positioning arm is positionally adjustable to a plurality of frame attaching portions provided at said carriage.

16. A work positioning device for a computer sewing machine having a memory for storing therein a pattern data of a plurality of different embroidery patterns which are selectively read out of the memory to drive a carriage of the sewing machine carrying an embroidery frame holding a work to be embroidered, thereby to control an operation of the embroidery frame relative to a machine needle, the embroidery frame being set to an initialized position prior to starting an embroidery stitching operation, said work positioning device comprising:

an auxiliary table of the computer sewing machine having a portion provided therewith for supporting said embroidery frame, said frame supporting portion of the auxiliary table corresponding to one of a plurality of positions of said carriage;

a positioning arm having one end removably and turnably connected to a holding means provided on said auxiliary table, said positioning arm having a positioning part provided at an opposite end for positioning said work so that a selected pattern may be stitched at an optional position of said work;

said positioning arm being movable between an upper position where said positioning part is spaced from an upper surface of said auxiliary table and a lower position where said positioning part is in contact with the upper surface of said auxiliary table;

said positioning part having a reference mark of crossed lines provided thereat, said reference mark showing a an initialized position for starting a pattern stitching operation when said embroidery frame is connected to said carriage;

said work having a mark of crossed lines provided at an optional position thereof, said mark of crossed lines being put upon said reference mark of crossed lines of said positioning part so that the mark of crossed lines come in accord with said reference mark, thereby to confirm a position of said work to be held by said embroidery frame, the position of said work corresponding to the initialized position of said carriage, while said embroidery frame is connected to said frame supporting portion of said auxiliary table, wherein said positioning part includes a transparent plate having said reference mark of crossed lines provided thereat showing the initialized position for starting the pattern stitching operation when said embroidery frame is connected to said carriage of the sewing machine, and wherein said positioning arm is positionally adjustable to a plurality of frame attaching portions provided at said carriage.

* * * * *